US008754016B2

(12) United States Patent
Tagawa et al.

(10) Patent No.: US 8,754,016 B2
(45) **Date of Patent: *Jun. 17, 2014**

(54) LUBRICANT BASE OIL, METHOD FOR PRODUCTION THEREOF, AND LUBRICANT OIL COMPOSITION

(75) Inventors: Kazuo Tagawa, Yokohama (JP); Shinichi Shirahama, Yokohama (JP); Masahiro Taguchi, Yokohama (JP)

(73) Assignee: JX Nippon Oil & Energy Corporation, Tokyo (JP)

( * ) Notice: Subject to any disclaimer, the term of this patent is extended or adjusted under 35 U.S.C. 154(b) by 369 days.

This patent is subject to a terminal disclaimer.

(21) Appl. No.: 12/593,400

(22) PCT Filed: Mar. 25, 2008

(86) PCT No.: PCT/JP2008/055574

§ 371 (c)(1), (2), (4) Date: Nov. 17, 2009

(87) PCT Pub. No.: WO2008/123246

PCT Pub. Date: Oct. 16, 2008

(65) Prior Publication Data

US 2010/0130395 A1 May 27, 2010

(30) Foreign Application Priority Data

Mar. 30, 2007 (JP) ..... 2007-092592

(51) Int. Cl.
*C10M 115/08* (2006.01)
*C10M 169/04* (2006.01)
*C10G 71/00* (2006.01)

(52) U.S. Cl.
USPC ..... 508/110; 508/552; 208/18

(58) Field of Classification Search
USPC ..... 508/110, 555, 552; 208/18
See application file for complete search history.

(56) References Cited

U.S. PATENT DOCUMENTS

| | | | | |
|---|---|---|---|---|
| 2,861,941 | A * | 11/1958 | Jancosek et al. | 208/25 |
| 2,890,161 | A | 6/1959 | Brown et al. | |
| 3,078,222 | A | 2/1963 | Henke et al. | |
| 3,847,790 | A | 11/1974 | Putz et al. | |
| 4,606,834 | A | 8/1986 | Hart et al. | |
| 5,282,958 | A | 2/1994 | Santilli et al. | |
| 5,520,832 | A | 5/1996 | Alexander | |
| 6,090,989 | A * | 7/2000 | Trewella et al. | 585/13 |
| 6,103,099 | A * | 8/2000 | Wittenbrink et al. | 208/27 |
| 6,179,994 | B1 * | 1/2001 | Clark et al. | 208/27 |
| 6,420,618 | B1 * | 7/2002 | Berlowitz et al. | 585/310 |
| 6,602,402 | B1 | 8/2003 | Benazzi et al. | |
| 7,285,206 | B2 | 10/2007 | Germaine | |
| 7,641,786 | B2 | 1/2010 | Wang et al. | |
| 7,642,095 | B2 | 1/2010 | Wang et al. | |
| 7,914,665 | B2 | 3/2011 | Zhang et al. | |
| 8,030,255 | B2 | 10/2011 | Matsui et al. | |
| 2002/0119896 | A1 | 8/2002 | Yagishita et al. | |
| 2004/0045868 | A1 | 3/2004 | Germaine | |
| 2004/0065588 | A1 | 4/2004 | Genetti et al. | |
| 2004/0074810 | A1 | 4/2004 | Hoeck et al. | |
| 2004/0077505 | A1 | 4/2004 | Daniel et al. | |
| 2004/0077509 | A1 | 4/2004 | Yuki et al. | |
| 2004/0079675 | A1 | 4/2004 | Germaine et al. | |
| 2004/0092409 | A1 | 5/2004 | Liesen | |
| 2004/0099571 | A1 | 5/2004 | Germaine et al. | |
| 2004/0108248 | A1 | 6/2004 | Cody et al. | |
| 2004/0108249 | A1 | 6/2004 | Cody et al. | |
| 2004/0118744 | A1 | 6/2004 | Daniel et al. | |
| 2004/0119046 | A1 | 6/2004 | Carey et al. | |
| 2004/0129603 | A1 | 7/2004 | Fyfe et al. | |
| 2004/0154957 | A1 | 8/2004 | Keeney et al. | |
| 2004/0154958 | A1 | 8/2004 | Alexander et al. | |
| 2005/0261147 | A1 | 11/2005 | Rosenbaum et al. | |
| 2006/0205610 | A1 * | 9/2006 | Rosenbaum et al. | 508/110 |
| 2007/0138052 | A1 | 6/2007 | Kobayashi et al. | |
| 2007/0191239 | A1 | 8/2007 | Matsuoka et al. | |
| 2007/0287643 | A1 | 12/2007 | Matsui et al. | |
| 2008/0116108 | A1 | 5/2008 | Zhang et al. | |
| 2008/0163672 | A1 | 7/2008 | Wang et al. | |
| 2008/0206878 | A1 | 8/2008 | Wang et al. | |
| 2010/0041572 | A1 | 2/2010 | Sano et al. | |

(Continued)

FOREIGN PATENT DOCUMENTS

| | | |
|---|---|---|
| CN | 1500133 | 5/2004 |
| CN | 101065469 | 10/2007 |

(Continued)

OTHER PUBLICATIONS

International Search Report issued in connection with PCT/JP2008/055574, mailed Jun. 24, 2008.

Search report from E.P.O. that issued patent family member European Patent Application No. 08856395.2 on May 26, 2011, mail date is May 26, 2011.

Lilianna Z Pillon, "Use of NMR Spectroscopy to Study the Effect of Hydrocraking on the Chemistry of Hydrocarbons", Petroleum Science and Technology, Marcel Dekker, New York, NY, US, vol. 20, No. 3&4, XP009148193 , Jan. 1, 2002, pp. 357-365.

Veretennikova T N et al., "Mechanism of action of pour-point depressants in diesel fuels ", Chemistry and Technology of Fuels and Oils, Consultants Bureau, US, vol. 16, No. 6, XP007918564, Jan. 1, 1980, pp. 392-395.

(Continued)

*Primary Examiner* — Prem C Singh
*Assistant Examiner* — Francis C Campanell
(74) *Attorney, Agent, or Firm* — Greenblum & Bernstein, P.L.C.

(57) ABSTRACT

The lubricating base oil of the invention is characterized by having an urea adduct value of not greater than 4% by mass and a viscosity index of 100 or greater. The process for production of a lubricating base oil according to the invention is characterized by comprising a step of hydrocracking/hydroisomerization of a stock oil containing normal paraffins, until the obtained treatment product has an urea adduct value of not greater than 4% by mass and a viscosity index of 100 or greater. A lubricating oil composition according to the invention is characterized by comprising the lubricating base oil of the invention.

7 Claims, No Drawings

(56) References Cited

U.S. PATENT DOCUMENTS

| | | | | |
|---|---|---|---|---|
| 2010/0130395 | A1 | 5/2010 | Tagawa et al. | |
| 2010/0137176 | A1* | 6/2010 | Aoki et al. | 508/552 |
| 2010/0190671 | A1 | 7/2010 | Stoehr et al. | |
| 2011/0003725 | A1 | 1/2011 | Matsui et al. | |
| 2011/0049008 | A1* | 3/2011 | Tagawa et al. | 208/18 |
| 2011/0049009 | A1* | 3/2011 | Tagawa et al. | 208/18 |

FOREIGN PATENT DOCUMENTS

| | | |
|---|---|---|
| EP | 0021634 | 1/1981 |
| EP | 1 749 876 | 2/2007 |
| EP | 1845151 | 10/2007 |
| EP | 1 997 871 | 12/2007 |
| EP | 2135929 | 12/2009 |
| EP | 2241611 | 10/2010 |
| JP | S30-624 | 2/1955 |
| JP | S31-3928 | 5/1956 |
| JP | S45-19183 | 7/1970 |
| JP | S48-25003 | 4/1973 |
| JP | 56-2398 | 1/1981 |
| JP | 4036391 | 2/1992 |
| JP | 4-068082 | 3/1992 |
| JP | 4068082 | 3/1992 |
| JP | 4-120193 | 4/1992 |
| JP | 4120193 | 4/1992 |
| JP | 5-508876 | 12/1993 |
| JP | 06-306384 | 11/1994 |
| JP | 08-302378 | 11/1996 |
| JP | 2000-345170 | 12/2000 |
| JP | 2000-345171 | 12/2000 |
| JP | 2001-181664 | 7/2001 |
| JP | 2001-279287 | 10/2001 |
| JP | 2001-520302 | 10/2001 |
| JP | 2002-503752 | 2/2002 |
| JP | 2002-503754 | 2/2002 |
| JP | 2002-105477 | 4/2002 |
| JP | 2002-129182 | 5/2002 |
| JP | 2003-292938 | 10/2003 |
| JP | 2004-124080 | 4/2004 |
| JP | 2004-169029 | 6/2004 |
| JP | 2004-521976 | 7/2004 |
| JP | 2004-521977 | 7/2004 |
| JP | 2004-522848 | 7/2004 |
| JP | 2004-526831 | 9/2004 |
| JP | 2004-528426 | 9/2004 |
| JP | 2004-536894 | 12/2004 |
| JP | 2005-154760 | 6/2005 |
| JP | 2005-187736 | 7/2005 |
| JP | 2005-239840 | 9/2005 |
| JP | 2006-502289 | 1/2006 |
| JP | 2006-502297 | 1/2006 |
| JP | 2006-502298 | 1/2006 |
| JP | 2006-502303 | 1/2006 |
| JP | 2006-509899 | 3/2006 |
| JP | 2006-117851 | 5/2006 |
| JP | 2006-518395 | 8/2006 |
| JP | 2006-241436 | 9/2006 |
| JP | 2006-521416 | 9/2006 |
| JP | 2007-002009 | 1/2007 |
| JP | 2007-045850 | 2/2007 |
| JP | 2007-137952 | 6/2007 |
| JP | 2007-186638 | 7/2007 |
| JP | 2007-217494 | 8/2007 |
| JP | 2007-246659 | 9/2007 |
| JP | 2007-246661 | 9/2007 |
| JP | 2007-254559 | 10/2007 |
| JP | 2007-269885 | 10/2007 |
| JP | 2007-270059 | 10/2007 |
| JP | 2007-270062 | 10/2007 |
| JP | 2007-326963 | 12/2007 |
| JP | 2008-520770 | 6/2008 |
| JP | 2010-532805 | 10/2010 |
| WO | 2004/053030 | 6/2004 |
| WO | 2005/090528 | 9/2005 |
| WO | 2005/0950528 | 9/2005 |
| WO | WO 2005/090528 | 9/2005 |
| WO | 2006/055901 | 5/2006 |
| WO | 2007/114132 | 10/2007 |
| WO | 2007/114260 | 10/2007 |
| WO | 2010/010807 | 1/2010 |
| WO | 2010/041689 | 4/2010 |
| WO | 2010/041692 | 4/2010 |

OTHER PUBLICATIONS

Krishna R et al., "Correlation of pour point of gas oil and vacuum gas oil fractions with compositional parameters", Energy & Fuels, American Chemical Society, Washington, DC, US, vol. 3, No. 1, XP007918565, Jan. 1, 1989, pp. 15-20.

Turner C H et al., "Estimation of chain branching in paraffin waxes using proton magnetic resonance spectroscopy and gas-liquid chromatography", Journal of Chromatography, Elsevier Science Publishers B. V. NL, vol. 287, XP026476547, Jan. 1, 1984, pp. 305-312.

Sharma et al., "Predicting Low Temperature Lubricant Rheology Using Nuclear Magnetic Resonance Spectroscopy and Mass Spectrometry", Tribology Letters, Kluwer Academic Publishers—Plenum Publishers, NE, vol. 16, No. 1-2, XP007918586, Feb. 1, 2004, pp. 11-19.

Search report from E.P.O. that issued with respect to patent family member European Patent Application No. 08722784.9, mail date is May 27, 2011.

English Language Abstract of 2006-241436.

International Preliminary Report on Patentability (in English), including the Written Opinion, for PCT/JP2008/071968, mailed Aug. 19, 2010.

English language Abstract of WO 2004/033596, corresponding to JP 2006-502289, Jan. 19, 2006.

English language Abstract of WO 2004/033597, corresponding to JP 2006-502297, Jan. 19, 2006.

English language Abstract of WO 2004/065588, corresponding to JP 2006-502298, Jan. 19, 2006.

English language Abstract of WO 2004/033606, corresponding to JP 2006-502303, Jan. 19, 2006.

English language Abstract of WO 99/41334, corresponding to JP 2002-503754 , Feb. 5, 2002.

English language Abstract of US 2004/154957, corresponding to JP 2006-509899, Mar. 23, 2006.

English language Abstract of WO 2004/053034, corresponding to JP 2006-518395, Aug. 10, 2006.

English language Abstract of WO 2004/053030, corresponding to JP 2006-521416, Sep. 21, 2006.

English language Abstract of WO 02/064710, corresponding to JP 2004-521976, Jul. 22, 2004.

English language Abstract of US 2004/045868, corresponding to JP 2004-522848, Jul. 29, 2004.

English language Abstract of US 2004/045868, corresponding to JP 2004-526831, Sep. 2, 2004.

English language Abstract of US 2004/074810, corresponding to JP 2004-536894, Dec. 9, 2004.

English language Abstract of WO 02/064710, corresponding to JP 2004-521977, Jul. 22, 2004.

Chinese Office action issued with respect to Chinese Patent Application No. 200880010885.6, mailed Apr. 23, 2012.

Office Action issued with respect to Japanese Patent Application No. 2008-006038, mailed Dec. 4, 2012.

Notification of Information Provision issued in patent family member Japanese Patent Application No. 2009-509113, mailed Jun. 26, 2012.

Shinya Sato et al., "Separation of n-Paraffin and 1-Olefin in Shale Oil by Urea Adduct Method", Sekiyu Gakkaishi, vol. 39, No. 5, 1996, pp. 365-368 with partial English language translation.

Search Report issued with respect to European Patent Application No. 12003139.8, mailed Jul. 10, 2012.

Office Action issued with respect to Chinese Patent Application No. 200880119102.8, mailed Jul. 31, 2012.

Notification of Information Provision issued with respect to Japanese Patent Application No. 2008-309013, mailed Oct. 2, 2012.

(56) References Cited

OTHER PUBLICATIONS

Office Action issued in relation to U.S. Appl. No. 12/745,917, mailed Jun. 21, 2012.
Search Report from E.P.O. issued in relation to European Patent Application No. 11010052.6.
Notification of Information Provision issued with respect to Japanese Patent Application No. 2007-340431, mailed Jan. 8, 2013.
Notification of Information Provision issued with respect to Japanese Patent Application No. 2007-340431, mailed Feb. 12, 2013.
Tanaka, "Lecture, Fundamentals of Lubricant Additives (3), Viscosity Index Improver", The Tribologist, vol. 52, No. 11, pp. 789-792 (Jun. 6, 2007), with partial translation thereof.
Yamada, "Grade of Engine Oils", Society of Automotive Engineers of Japan, vol. 53, No. 4, pp. 86-89 (Feb. 12, 1999), with partial translation thereof.
Office Action from JP Patent Application No. 2009-509113, mailed on May 14, 2013.
Notification of Information Provision for JP Patent Application No. 2008-006038, mailed on May 15, 2013.
Hiroshi Ohtsuka et al., "Separation of Straight-chain hydrocarbons from petroleum fractions by means of urea-adduct formation", Bulletin of the Faculty of Engineering, Hokkaido University, 40, Mar. 30, 1966, p. 125-137; and partial English translation thereof.
Yozo Oshima et al., "Monomethylparaffins in n-paraffins Adducted from Petroleum Fractions", Sekiyu Gakkaishi, vol. 18, No. 6, 1975, p. 497-502.
"Glossary of Lubrication Terminology—with definitions" Japanese Society of Lubrication, vol. 3, No. 1, Jul. 20, 1981; and a partial English translation thereof.
V.J. Gatto et al. "The influence of chemical structure on the physical properties and antioxidant response of hydrocracked base stocks and polyalphaolefins" J. Synthetic Lubrication 19-1, Apr. 2002, p. 3-18.
Helen T. Ryan, "Use of Group I and Group III base stock in hydraulic and industrial Applications", Industrial lubrication and tribology 51, 1999, p. 287-293.
Jinichi Igarashi, "Current Situation and future trends in Lubricant base oils," The Tribologist, vol. 48, No. 4, 2003, p. 265-271; and partial English translation thereof.
Notification of Information Provision for non-counterpart JP Patent Application No. P2007-340431, mailed on Jul. 23, 2013.
Notification of Information Provision for non-counterpart JP Application No. 2008-006038, mailed Sep. 3, 2013.
Office Action for JP Patent Application No. P2008-006038, mailed on Oct. 22, 2013.
Office Action for counterpart JP Patent Application No. 2009-509113, which was mailed on Mar. 25, 2014.

* cited by examiner

LUBRICANT BASE OIL, METHOD FOR PRODUCTION THEREOF, AND LUBRICANT OIL COMPOSITION

TECHNICAL FIELD

The present invention relates to a lubricating base oil, a process for its production and a lubricating oil composition.

BACKGROUND ART

In the field of lubricating oils, additives such as pour point depressants have conventionally been added to lubricating base oils including highly refined mineral oils, to improve the properties such as the low-temperature viscosity characteristic of the lubricating oils (see Patent documents 1-3, for example). Known processes for production of high-viscosity-index base oils include processes in which stock oils containing natural or synthetic normal paraffins are subjected to lubricating base oil refining by hydrocracking/hydroisomerization (see Patent documents 4-6, for example).

Evaluation standards of the low-temperature viscosity characteristic of lubricating base oils and lubricating oils are generally the pour point, clouding point and freezing point. Methods are also known for evaluating the low-temperature viscosity characteristic based on the lubricating base oils, according to their normal paraffin or isoparaffin contents.

[Patent document 1] Japanese Unexamined Patent Publication HEI No. 4-36391

[Patent document 2] Japanese Unexamined Patent Publication HEI No. 4-68082

[Patent document 3] Japanese Unexamined Patent Publication HEI No. 4-120193

[Patent document 4] Japanese Unexamined Patent Publication No. 2005-154760

[Patent document 5] Japanese Patent Public Inspection No. 2006-502298

[Patent document 6] Japanese Patent Public Inspection No. 2002-503754

DISCLOSURE OF THE INVENTION

Problems to be Solved by the Invention

However, with demands increasing in recent years for improved low-temperature viscosity characteristics of lubricating oils and also both low-temperature viscosity characteristics and viscosity-temperature characteristics, it has been difficult to completely satisfy such demands even when using lubricating base oils judged to have satisfactory low-temperature performance based on conventional evaluation standards.

Including additives in lubricating base oils can result in some improvement in the properties, but this method has had its own restrictions. Pour point depressants, in particular, do not exhibit effects proportional to the amounts in which they are added, and even reduce shear stability when added in increased amounts.

It has also been attempted to optimize the conditions for hydrocracking/hydroisomerization in refining processes for lubricating base oils that make use of hydrocracking/hydroisomerization as mentioned above, from the viewpoint of increasing the isomerization rate from normal paraffins to isoparaffins and improving the low-temperature viscosity characteristic by lowering the viscosity of the lubricating base oil, but because the viscosity-temperature characteristic (especially high-temperature viscosity characteristic) and the low-temperature viscosity characteristic are in an inverse relationship, it has been extremely difficult to achieve both of these. For example, increasing the isomerization rate from normal paraffins to isoparaffins improves the low-temperature viscosity characteristic but results in an unsatisfactory viscosity-temperature characteristic, including a reduced viscosity index. The fact that the above-mentioned standards such as pour point and freezing point are often unsuitable for evaluating the low-temperature viscosity characteristic of lubricating base oils is another factor that impedes optimization of the hydrocracking/hydroisomerization conditions.

The present invention has been accomplished in light of these circumstances, and it is an object of the invention to provide a lubricating base oil capable of exhibiting high levels of both viscosity-temperature characteristic and low-temperature viscosity characteristic, as well as a process for its production, and a lubricating oil composition comprising the lubricating base oil.

Means for Solving the Problems

In order to solve the problems described above, the invention provides a lubricating base oil characterized by having an urea adduct value of not greater than 4% by mass and a viscosity index of 100 or greater.

The urea adduct value according to the invention is measured by the following method. A 100 g weighed portion of sample oil (lubricating base oil) is placed in a round bottom flask, 200 g of urea, 360 ml of toluene and 40 ml of methanol are added and the mixture is stirred at room temperature for 6 hours. This produces white particulate crystals as urea adduct in the reaction mixture. The reaction mixture is filtered with a 1 micron filter to obtain the produced white particulate crystals, and the crystals are washed 6 times with 50 ml of toluene. The recovered white crystals are placed in a flask, 300 ml of purified water and 300 ml of toluene are added and the mixture is stirred at 80° C. for 1 hour. The aqueous phase is separated and removed with a separatory funnel, and the toluene phase is washed 3 times with 300 ml of purified water. After dewatering treatment of the toluene phase by addition of a desiccant (sodium sulfate), the toluene is distilled off. The proportion (mass percentage) of urea adduct obtained in this manner with respect to the sample oil is defined as the urea adduct value.

The viscosity index according to the invention, and the 40° C. or 100° C. dynamic viscosity mentioned hereunder, are the viscosity index and 40° C. or 100° C. dynamic viscosity as measured according to JIS K 2283-1993.

According to the lubricating base oil of the invention, the urea adduct value and viscosity index satisfy the respective conditions specified above, thereby allowing high levels of both viscosity-temperature characteristic and low-temperature viscosity characteristic to be obtained. When an additive such as a pour point depressant is added to the lubricating base oil of the invention, the effect of its addition is exhibited more effectively. Thus, the lubricating base oil of the invention is highly useful as a lubricating base oil that can meet recent demands in terms of both low-temperature viscosity characteristic and viscosity-temperature characteristic. In addition, according to the lubricating base oil of the invention it is possible to reduce viscosity resistance and stirring resistance in a practical temperature range due to its aforementioned superior viscosity-temperature characteristic. In particular, the lubricating base oil of the invention can exhibit this effect by significantly reducing viscosity resistance and stirring resistance under low temperature conditions of 0° C. and below, and it is therefore highly useful for reducing energy loss and achieving energy savings in devices in which the lubricating base oil is applied.

While efforts are being made to improve the isomerization rate from normal paraffins to isoparaffins in conventional refining processes for lubricating base oils by hydrocracking and hydroisomerization, as mentioned above, the present inventors have found that it is difficult to satisfactorily improve the low-temperature viscosity characteristic simply by reducing the residual amount of normal paraffins. That is, although the isoparaffins produced by hydrocracking and hydroisomerization also contain components that adversely affect the low-temperature viscosity characteristic, this fact has not been fully appreciated in the conventional methods of evaluation. Methods such as gas chromatography (GC) and NMR are also applied for analysis of normal paraffins and isoparaffins, but using these analysis methods for separation and identification of the components in isoparaffins that adversely affect the low-temperature viscosity characteristic involves complicated procedures and is time-consuming, making them ineffective for practical use.

With measurement of the urea adduct value according to the invention, on the other hand, it is possible to accomplish precise and reliable collection of components in isoparaffins that can adversely affect the low-temperature viscosity characteristic, as well as normal paraffins when normal paraffins are residually present in the lubricating base oil, and it is therefore an excellent evaluation standard of the low-temperature viscosity characteristic of lubricating base oils. The present inventors have confirmed that when analysis is conducted using GC and NMR, the main urea adducts are urea adducts of normal paraffins and of isoparaffins with 6 or more carbon atoms from the end of the main chain to the point of branching.

As an example of a preferred embodiment of the lubricating base oil of the invention, there may be mentioned a lubricating base oil with an urea adduct value of not greater than 4% by mass, a viscosity index of 130 or greater and a NOACK evaporation amount of not greater than 15% by mass.

As another preferred embodiment of the lubricating base oil of the invention, there may be mentioned a lubricating base oil with an urea adduct value of not greater than 4% by mass, a viscosity index of 130 or greater, a −35° C. CCS viscosity of not greater than 2000 mPa·s and a product of the 40° C. dynamic viscosity (units: $mm^2/s$) and NOACK evaporation amount (units: % by mass) of not greater than 250.

Moreover, the invention provides a process for production of a lubricating base oil characterized by comprising a step of hydrocracking/hydroisomerization of a stock oil containing normal paraffins, until the obtained treatment product has an urea adduct value of not greater than 4% by mass and a viscosity index of 100 or greater.

According to the process for production of a lubricating base oil according to the invention, it is possible to reliably obtain a lubricating base oil with high levels of both viscosity-temperature characteristic and low-temperature viscosity characteristic, by hydrocracking/hydroisomerization of a stock oil containing normal paraffins until the obtained treatment product has an urea adduct value of not greater than 4% by mass and a viscosity index of 100 or greater.

As an example of a preferred embodiment of the process for production of a lubricating base oil according to the invention, there may be mentioned a process for production of a lubricating base oil comprising a step of hydrocracking/hydroisomerization of a stock oil containing normal paraffins, until the urea adduct value of the obtained treatment product is not greater than 4% by mass, the viscosity index is 130 or greater and the NOACK evaporation amount is not greater than 15% by mass.

As another preferred embodiment of the process for production of a lubricating base oil according to the invention there may be mentioned a process for production of a lubricating base oil comprising a step of hydrocracking/hydroisomerization of a stock oil containing normal paraffins, until the urea adduct value of the obtained treatment product is not greater than 4% by mass, the viscosity index is 130 or greater, the −35° C. CCS viscosity is not greater than 2000 mPa·s, and the product of the 40° C. dynamic viscosity (units: $mm^2/s$) and the NOACK evaporation amount (units: % by mass) is not greater than 250.

In the process for production of a lubricating base oil according to the invention, it is preferred for the stock oil to containing at least 50% by mass slack wax obtained by solvent dewaxing of the lubricating base oil.

The invention still further provides a lubricating oil composition characterized by comprising the aforementioned lubricating base oil of the invention.

Since a lubricating oil composition according to the invention contains a lubricating base oil of the invention having the excellent properties described above, it is useful as a lubricating oil composition capable of exhibiting high levels of both viscosity-temperature characteristic and low-temperature viscosity characteristic. Since the effects of adding additives to the lubricating base oil of the invention can be effectively exhibited, as explained above, various additives may be optimally added to the lubricating oil composition of the invention.

Effect of the Invention

According to the invention there are provided a lubricating base oil capable of exhibiting high levels of both viscosity-temperature characteristic and low-temperature viscosity characteristic, as well as a process for its production, and a lubricating oil composition comprising the lubricating base oil.

BEST MODE FOR CARRYING OUT THE INVENTION

Preferred embodiments of the invention will now be described in detail.

The lubricating base oil of the invention has an urea adduct value of not greater than 4% by mass and a viscosity index of 100 or greater.

From the viewpoint of improving the low-temperature viscosity characteristic without impairing the viscosity-temperature characteristic, the urea adduct value of the lubricating base oil of the invention must be not greater than 4% by mass as mentioned above, but it is preferably not greater than 3.5% by mass, more preferably not greater than 3% by mass and even more preferably not greater than 2.5% by mass. The urea adduct value of the lubricating base oil may even be 0% by mass. However, it is preferably 0.1% by mass or greater, more preferably 0.5% by mass or greater and particularly preferably 0.8% by mass or greater, from the viewpoint of obtaining a lubricating base oil with a sufficient low-temperature viscosity characteristic and higher viscosity index, and also of relaxing the dewaxing conditions for increased economy.

From the viewpoint of improving the viscosity-temperature characteristic, the viscosity index of the lubricating base oil of the invention must be 100 or greater as mentioned above, but it is preferably 110 or greater, more preferably 120 or greater, even more preferably 130 or greater and particularly preferably 140 or greater.

The stock oil used for production of the lubricating base oil of the invention may include normal paraffins or normal paraffin-containing wax. The stock oil may be a mineral oil or a synthetic oil, or a mixture of two or more thereof.

The stock oil used for the invention preferably is a wax-containing starting material that boils in the range of lubricating oils according to ASTM D86 or ASTM D2887. The wax content of the stock oil is preferably between 50% by mass and 100% by mass based on the total mass of the stock oil. The wax content of the starting material can be measured by a method of analysis such as nuclear magnetic resonance spectroscopy (ASTM D5292), correlative ring analysis (n-d-M) (ASTM D3238) or the solvent method (ASTM D3235).

As examples of wax-containing starting materials there may be mentioned oils derived from solvent refining methods, such as raffinates, partial solvent dewaxed oils, deasphalted oils, distillates, vacuum gas oils, coker gas oils, slack waxes, foot oil, Fischer-Tropsch waxes and the like, among which slack waxes and Fischer-Tropsch waxes are preferred.

Slack wax is typically derived from hydrocarbon starting materials by solvent or propane dewaxing. Slack waxes may contain residual oil, but the residual oil can be removed by deoiling. Foot oil corresponds to deoiled slack wax.

Fischer-Tropsch waxes are produced by so-called Fischer-Tropsch synthesis.

Commercial normal paraffin-containing stock oils are also available. Specifically, there may be mentioned Paraflint 80 (hydrogenated Fischer-Tropsch wax) and Shell MDS Waxy Raffinate (hydrogenated and partially isomerized heart-cut distilled synthetic wax raffinate).

Stock oil from solvent extraction is obtained by feeding a high boiling point petroleum fraction from atmospheric distillation to a vacuum distillation apparatus and subjecting the distillation fraction to solvent extraction. The residue from vacuum distillation may also be deasphalted. In solvent extraction methods, the aromatic components are dissolved in the extracted phase while leaving the more paraffinic components in the raffinate phase. Naphthenes are distributed in the extracted phase and raffinate phase. The preferred solvents for solvent extraction are phenols, furfurals and N-methylpyrrolidone. By controlling the solvent/oil ratio, extraction temperature and method of contacting the solvent with the distillate to be extracted, it is possible to control the degree of separation between the extract phase and raffinate phase. There may also be used as the starting material a bottom fraction obtained from a hydrotreatment apparatus, using a hydrotreatment apparatus with higher hydrocracking performance.

The lubricating base oil of the invention may be obtained through a step of hydrocracking/hydroisomerization of the stock oil until the treatment product has an urea adduct value of not greater than 4% by mass and a viscosity index of 100 or greater. The hydrocracking/hydroisomerization step is not particularly restricted so long as it satisfies the aforementioned conditions for the urea adduct value and viscosity index of the treatment product. A preferred hydrocracking/hydroisomerization step according to the invention comprises a first step in which a normal paraffin-containing stock oil is subjected to hydrotreatment using a hydrotreatment catalyst, a second step in which the treatment product obtained from the first step is subjected to hydrodewaxing using a hydrodewaxing catalyst, and a third step in which the treatment product obtained from the second step is subjected to hydrorefining using a hydrorefining catalyst.

Conventional hydrocracking/hydroisomerization also includes a hydrotreatment step in an early stage of the hydrodewaxing step, for the purpose of desulfurization and denitrification to prevent poisoning of the hydrodewaxing catalyst. In contrast, the first step (hydrotreatment step) according to the invention is carried out to decompose a portion (for example, about 10% by mass and preferably 1-10% by mass) of the normal paraffins in the stock oil at an early stage of the second step (hydrodewaxing step), thus allowing desulfurization and denitrification in the first step as well, although the purpose differs from that of conventional hydrotreatment. The first step is preferred in order to reliably limit the urea adduct value of the treatment product obtained after the third step (the lubricating base oil) to not greater than 4% by mass.

As hydrogenation catalysts to be used in the first step there may be mentioned catalysts containing Group 6 metals and Group 8-10 metals, as well as mixtures thereof. As preferred metals there may be mentioned nickel, tungsten, molybdenum and cobalt, and mixtures thereof. The hydrogenation catalyst may be used in a form with the aforementioned metals supported on a heat resistant metal oxide carrier, and normally the metal will be present on the carrier as an oxide or sulfide. When a mixture of metals is used, it may be used as a bulk metal catalyst with an amount of metal of at least 30% by mass based on the total mass of the catalyst. The metal oxide carrier may be an oxide such as silica, alumina, silica-alumina or titania, with alumina being preferred. Preferred alumina is $\gamma$ or $\beta$ porous alumina. The loading mass of the metal is preferably 0.5-35% by mass based on the total mass of the catalyst. When a mixture of a metal of Group 9-10 and a metal of Group 6 is used, preferably the metal of Group 9 or 10 is present in an amount of 0.1-5% by mass and the metal of Group 6 is present in an amount of 5-30% by mass based on the total mass of the catalyst. The loading mass of the metal may be measured by atomic absorption spectrophotometry or inductively coupled plasma emission spectroscopy, or the individual metals may be measured by other ASTM methods.

The acidity of the metal oxide carrier can be controlled by controlling the addition of additives and the nature of the metal oxide carrier (for example, controlling the amount of silica incorporated in a silica-alumina carrier). As examples of additives there may be mentioned halogens, especially fluorine, and phosphorus, boron, yttria, alkali metals, alkaline earth metals, rare earth oxides and magnesia. Co-catalysts such as halogens generally raise the acidity of metal oxide carriers, but weakly basic additives such as yttria and magnesia can be used to lower the acidity of the carrier.

As regards the hydrotreatment conditions, the treatment temperature is preferably 150-450° C. and more preferably 200-400° C., the hydrogen partial pressure is preferably 1406-20000 kPa and more preferably 2800-14000 kPa, the liquid hourly space velocity (LHSV) is preferably 0.1-10 $hr^{-1}$ and more preferably 0.1-5 $hr^{-1}$, and the hydrogen/oil ratio is preferably 50-1780 $m^3/m^3$ and more preferably 89-890 $m^3/m^3$. These conditions are only for example, and the hydrotreatment conditions in the first step may be appropriately selected depending on difference of starting materials, catalysts and apparatuses, in order to obtain the specified urea adduct value and viscosity index for the treatment product obtained after the third step.

The treatment product obtained by hydrotreatment in the first step may be directly supplied to the second step, but a step of stripping or distillation of the treatment product and separating removal of the gas product from the treatment product (liquid product) is preferably conducted between the first step and second step. This can reduce the nitrogen and sulfur contents in the treatment product to levels that will not affect prolonged use of the hydrodewaxing catalyst in the second step. The main objects of separating removal by stripping and the like are gaseous contaminants such as hydrogen sulfide and ammonia, and stripping can be accomplished by ordinary means such as a flash drum, distiller or the like.

When the hydrotreatment conditions in the first step are mild, residual polycyclic aromatic components can potentially remain depending on the starting material used, and such contaminants may be removed by hydrorefining in the third step.

The hydrodewaxing catalyst used in the second step may contain crystalline or amorphous materials. As examples of crystalline materials there may be mentioned molecular sieves having 10- or 12-membered ring channels, composed mainly of aluminosilicates (zeolite) or silicoaluminophosphates (SAPO). As specific examples of zeolites there may be mentioned ZSM-22, ZSM-23, ZSM-35, ZSM-48, ZSM-57, ferrierite, ITQ-13, MCM-68, MCM-71 and the like. ECR-42 may be mentioned as an example of an aluminophosphate. As examples of molecular sieves there may be mentioned zeolite beta and MCM-68. Among the above there are preferably used one or more selected from among ZSM-48, ZSM-22 and ZSM-23, with ZSM-48 being particularly preferred. The molecular sieves are preferably hydrogen-type. Reduction of the hydrodewaxing catalyst may occur at the time of hydrodewaxing, but alternatively a hydrodewaxing catalyst that has been previously subjected to reduction treatment may be used for the hydrodewaxing.

As amorphous materials for the hydrodewaxing catalyst there may be mentioned alumina doped with Group 3 metals, fluorinated alumina, silica-alumina, fluorinated silica-alumina, silica-alumina and the like.

A preferred embodiment of the dewaxing catalyst is a bifunctional catalyst, i.e. one carrying a metal hydrogenated component which is at least one metal of Group 6, at least one metal of Groups 8-10, or a mixture thereof. Preferred metals are precious metals of Groups 9-10, such as Pt, Pd or mixtures thereof. Such metals are supported at preferably 0.1-30% by mass based on the total mass of the catalyst. The method for preparation of the catalyst and loading of the metal may be, for example, an ion exchange method or impregnation method using a decomposable metal salt.

When molecular sieves are used, they may be compounded with a binder material that is heat resistant under the hydrodewaxing conditions, or they may be binderless (self-binding). As binder materials there may be mentioned inorganic oxides, including silica, alumina, silica-alumina, two-component combinations of silica with other metal oxides such as titania, magnesia, thoria and zirconia, and three-containing combinations of oxides such as silica-alumina-thoria, silica-alumina-magnesia and the like. The amount of molecular sieves in the hydrodewaxing catalyst is preferably 10-100% by mass and more preferably 35-100% by mass based on the total mass of the catalyst. The hydrodewaxing catalyst may be formed by a method such as spray-drying or extrusion. The hydrodewaxing catalyst may be used in sulfided or non-sulfided form, although a sulfided form is preferred.

As regards the hydrodewaxing conditions, the temperature is preferably 250-400° C. and more preferably 275-350° C., the hydrogen partial pressure is preferably 791-20786 kPa (100-3000 psig) and more preferably 1480-17339 kPa (200-2500 psig), the liquid hourly space velocity is preferably 0.1-10 $hr^{-1}$ and more preferably 0.1-5 $hr^{-1}$, and the hydrogen/oil ratio is preferably 45-1780 $m^3/m^3$ (250-10000 scf/B) and more preferably 89-890 $m^3/m^3$ (500-5000 scf/B). These conditions are only for example, and the hydrodewaxing conditions in the second step may be appropriately selected depending on difference of starting materials, catalysts and apparatuses, in order to obtain the specified urea adduct value and viscosity index for the treatment product obtained after the third step.

The treatment product that has been hydrodewaxed in the second step is then supplied to hydrorefining in the third step. Hydrorefining is a form of mild hydrotreatment aimed at removing residual heteroatoms and color components while also saturating the olefins and residual aromatic compounds by hydrogenation. The hydrorefining in the third step may be carried out in a cascade fashion with the dewaxing step.

The hydrorefining catalyst used in the third step is preferably one comprising a Group 6 metal, a Group 8-10 metal or a mixture thereof supported on a metal oxide carrier. As preferred metals there may be mentioned precious metals, and especially platinum, palladium and mixtures thereof. When a mixture of metals is used, it may be used as a bulk metal catalyst with an amount of metal of 30% by mass or greater based on the mass of the catalyst. The metal content of the catalyst is preferably not greater than 20% by mass of non-precious metals and preferably not greater than 1% by mass of precious metals. The metal oxide carrier may be either an amorphous or crystalline oxide. Specifically, there may be mentioned low acidic oxides such as silica, alumina, silica-alumina and titania, with alumina being preferred. From the viewpoint of saturation of aromatic compounds, it is preferred to use a hydrorefining catalyst comprising a metal with a relatively powerful hydrogenating function supported on a porous carrier.

As preferred hydrorefining catalysts there may be mentioned meso-microporous materials belonging to the M41S class or M41S line catalysts. M41S line catalysts are meso-microporous materials with high silica contents, and specifically there may be mentioned MCM-41, MCM-48 and MCM-50. The hydrorefining catalyst has a pore size of 15-100 Å, and MCM-41 is particularly preferred. MCM-41 is an inorganic porous non-laminar phase with a hexagonal configuration and pores of uniform size. The physical structure of MCM-41 is straw-like bundles with straw openings (pore cell diameters) in the range of 15-100 angstroms. MCM-48 has cubic symmetry, while MCM-50 has a laminar structure. MCM-41 may also have a structure with pore openings having different meso-microporous ranges. The meso-microporous material may contain metal hydrogenated components consisting of one or more Group 8, 9 or 10 metals, and preferred as metal hydrogenated components are precious metals, especially Group 10 precious metals, and most preferably Pt, Pd or their mixtures.

As regards the hydrorefining conditions, the temperature is preferably 150-350° C. and more preferably 180-250° C., the total pressure is preferably 2859-20786 kPa (approximately 400-3000 psig), the liquid hourly space velocity is preferably 0.1-5 $hr^{-1}$ and more preferably 0.5-3 $hr^{-1}$, and the hydrogen/oil ratio is preferably 44.5-1780 $m^3/m^3$ (250-10000 scf/B). These conditions are only for example, and the hydrorefining conditions in the third step may be appropriately selected depending on difference of starting materials and treatment apparatuses, so that the urea adduct value and viscosity index for the treatment product obtained after the third step satisfy the respective conditions specified above.

The treatment product obtained after the third step may be subjected to distillation or the like as necessary for separating removal of certain components.

The lubricating base oil of the invention obtained by the production process described above is not restricted in terms of its other properties so long as the urea adduct value and viscosity index satisfy their respective conditions, but the lubricating base oil of the invention preferably also satisfies the conditions specified below.

The saturated component content of the lubricating base oil of the invention is preferably 90% by mass or greater, more preferably 93% by mass or greater and even more preferably 95% by mass or greater based on the total mass of the lubricating base oil. The proportion of cyclic saturated components among the saturated components is preferably 0.1-50% by mass, more preferably 0.5-40% by mass, even more preferably 1-30% by mass and particularly preferably 5-20% by mass. If the saturated component content and proportion of cyclic saturated components among the saturated components both satisfy these respective conditions, it will be possible to achieve adequate levels for the viscosity-temperature characteristic and thermal and oxidation stability, while additives added to the lubricating base oil will be kept in a sufficiently stable dissolved state in the lubricating base oil so that the functions of the additives can be exhibited at a higher level. In addition, a saturated component content and proportion of cyclic saturated components among the saturated components satisfying the aforementioned conditions can improve the frictional properties of the lubricating base oil itself, resulting in a greater friction reducing effect and thus increased energy savings.

If the saturated component content is less than 90% by mass, the viscosity-temperature characteristic, thermal and oxidation stability and frictional properties will tend to be inadequate. If the proportion of cyclic saturated components among the saturated components is less than 0.1% by mass, the solubility of the additives included in the lubricating base oil will be insufficient and the effective amount of additives kept dissolved in the lubricating base oil will be reduced, making it impossible to effectively achieve the function of the additives. If the proportion of cyclic saturated components among the saturated components is greater than 50% by mass, the efficacy of additives included in the lubricating base oil will tend to be reduced.

According to the invention, a proportion of 0.1-50% by mass cyclic saturated components among the saturated components is equivalent to 99.9-50% by mass acyclic saturated components among the saturated components. Both normal paraffins and isoparaffins are included by the term "acyclic saturated components". The proportions of normal paraffins and isoparaffins in the lubricating base oil of the invention are not particularly restricted so long as the urea adduct value satisfies the condition specified above, but the proportion of isoparaffins is preferably 50-99.9% by mass, more preferably 60-99.9% by mass, even more preferably 70-99.9% by mass and particularly preferably 80-99.9% by mass based on the total mass of the lubricating base oil. If the proportion of isoparaffins in the lubricating base oil satisfies the aforementioned conditions it will be possible to further improve the viscosity-temperature characteristic and thermal and oxidation stability, while additives added to the lubricating base oil will be kept in a sufficiently stable dissolved state in the lubricating base oil so that the functions of the additives can be exhibited at an even higher level.

The saturated component content for the purpose of the invention is the value measured according to ASTM D 2007-93 (units: % by mass).

The proportions of the cyclic saturated components and acyclic saturated components among the saturated components for the purpose of the invention are the naphthene portion (measurement of monocyclic-hexacyclic naphthenes, units: % by mass) and alkane portion (units: % by mass), respectively, both measured according to ASTM D 2786-91.

The proportion of normal paraffins in the lubricating base oil for the purpose of the invention is the value obtained by analyzing saturated components separated and fractionated by the method of ASTM D 2007-93 by gas chromatography under the following conditions, and calculating the value obtained by identifying and quantifying the proportion of normal paraffins among those saturated components, with respect to the total mass of the lubricating base oil. For identification and quantitation, a C5-50 normal paraffin mixture sample is used as the reference sample, and the normal paraffin content among the saturated components is determined as the proportion of the total of the peak areas corresponding to each normal paraffin, with respect to the total peak area of the chromatogram (subtracting the peak area for the diluent).

(Gas Chromatography Conditions)

Column: Liquid phase nonpolar column (length: 25 mm, inner diameter: 0.3 mmϕ, liquid phase film thickness: 0.1 μm), temperature elevating conditions: 50° C.-400° C. (temperature-elevating rate: 10° C./min).

Carrier gas: helium (linear speed: 40 cm/min)

Split ratio: 90/1

Sample injection rate: 0.5 μL (injection rate of sample diluted 20-fold with carbon disulfide).

The proportion of isoparaffins in the lubricating base oil is the value of the difference between the acyclic saturated components among the saturated components and the normal paraffins among the saturated components, based on the total mass of the lubricating base oil.

Other methods may be used for separation of the saturated components or for compositional analysis of the cyclic saturated components and acyclic saturated components, so long as they provide similar results. As examples of other methods there may be mentioned the method according to ASTM D 2425-93, the method according to ASTM D 2549-91, methods of high performance liquid chromatography (HPLC), and modified forms of these methods.

When the bottom fraction obtained from a hydrotreatment apparatus is used as the starting material for the lubricating base oil of the invention, the obtained base oil will have a saturated component content of 90% by mass or greater, a proportion of cyclic saturated components in the saturated components of 30-50% by mass, a proportion of acyclic saturated components in the saturated components of 50-70% by mass, a proportion of isoparaffins in the lubricating base oil of 40-70% by mass and a viscosity index of 100-135 and preferably 120-130, but if the urea adduct value satisfies the conditions specified above it will be possible to obtain a lubricating oil composition with the effect of the invention, i.e. an excellent low-temperature viscosity characteristic wherein the −40° C. MRV viscosity is not greater than 20000 mPa·s and especially not greater than 10000 mPa·s. When a slack wax or Fischer-Tropsch wax having a high wax content (for example, a normal paraffin content of 50% by mass or greater) is used as the starting material for the lubricating base oil of the invention, the obtained base oil will have a saturated component content of 90% by mass or greater, a proportion of cyclic saturated components in the saturated components of 0.1-40% by mass, a proportion of acyclic saturated components in the saturated components of 60-99.9% by mass, a proportion of isoparaffins in the lubricating base oil of 60-99.9% by mass and a viscosity index of 100-170 and preferably 135-160, but if the urea adduct value satisfies the conditions specified above it will be possible to obtain a lubricating oil composition with very excellent properties in terms of the effect of the invention, and especially the high viscosity index and low-temperature viscosity characteristic, wherein the −40° C. MRV viscosity is not greater than 12000 mPa·s and especially not greater than 7000 mPa·s.

If the 20° C. refractive index is represented as $n_{20}$ and the 100° C. dynamic viscosity is represented as kv100, the value of $n_{20}$-0.002×kv100 for the lubricating base oil of the invention is preferably 1.435-1.450, more preferably 1.440-1.449, even more preferably 1.442-1.448 and yet more preferably 1.444-1.447. If $n_{20}$-0.002×kv100 is within the range specified above it will be possible to achieve an excellent viscosity-temperature characteristic and thermal and oxidation stability, while additives added to the lubricating base oil will be kept in a sufficiently stable dissolved state in the lubricating base oil so that the functions of the additives can be exhibited at an even higher level. The $n_{20}$−0.002×kv100 value within the aforementioned range can also improve the frictional properties of the lubricating base oil itself, resulting in a greater friction reducing effect and thus increased energy savings.

If the $n_{20}$−0.002×kv100 value exceeds the aforementioned upper limit, the viscosity-temperature characteristic, thermal and oxidation stability and frictional properties will tend to be insufficient, and the efficacy of additives when added to the lubricating base oil will tend to be reduced. If the $n_{20}$-0.002×kv100 value is less than the aforementioned lower limit, the solubility of the additives included in the lubricating base oil will be insufficient and the effective amount of additives kept dissolved in the lubricating base oil will be reduced, making it impossible to effectively achieve the functions of the additives.

The 20° C. refractive index ($n_{20}$) for the purpose of the invention is the refractive index measured at 20° C. according to ASTM D1218-92. The 100° C. dynamic viscosity (kv100) for the purpose of the invention is the dynamic viscosity measured at 100° C. according to JIS K 2283-1993.

The aromatic content of the lubricating base oil of the invention is preferably not greater than 5% by mass, more preferably 0.05-3% by mass, even more preferably 0.1-1% by mass and particularly preferably 0.1-0.5% by mass based on the total mass of the lubricating base oil. If the aromatic content exceeds the aforementioned upper limit, the viscosity-temperature characteristic, thermal and oxidation stability, frictional properties, resistance to volatilization and low-temperature viscosity characteristic will tend to be reduced, while the efficacy of additives when added to the lubricating base oil will also tend to be reduced. The lubricating base oil of the invention may be free of aromatic components, but the solubility of additives can be further increased with an aromatic content of 0.05% by mass or greater.

The aromatic content in this case is the value measured according to ASTM D 2007-93. The aromatic portion normally includes alkylbenzenes and alkylnaphthalenes, as well as anthracene, phenanthrene and their alkylated forms, compounds with four or more condensed benzene rings, and heteroatom-containing aromatic compounds such as pyridines, quinolines, phenols, naphthols and the like.

The % $C_p$ value of the lubricating base oil of the invention is preferably 80 or greater, more preferably 82-99, even more preferably 85-98 and particularly preferably 90-97. If the % $C_p$ value of the lubricating base oil is less than 80, the viscosity-temperature characteristic, thermal and oxidation stability and frictional properties will tend to be reduced, while the efficacy of additives when added to the lubricating base oil will also tend to be reduced. If the %; value of the lubricating base oil is greater than 99, on the other hand, the additive solubility will tend to be lower.

The % $C_N$ value of the lubricating base oil of the invention is preferably not greater than 20, more preferably not greater than 15, even more preferably 1-12 and particularly preferably 3-10. If the % $C_N$ value of the lubricating base oil exceeds 20, the viscosity-temperature characteristic, thermal and oxidation stability and frictional properties will tend to be reduced. If the % $C_N$ is less than 1, the additive solubility will tend to be lower.

The % $C_A$ value of the lubricating base oil of the invention is preferably not greater than 0.7, more preferably not greater than 0.6 and even more preferably 0.1-0.5. If the % $C_A$ value of the lubricating base oil exceeds 0.7, the viscosity-temperature characteristic, thermal and oxidation stability and frictional properties will tend to be reduced. The % $C_A$ value of the lubricating base oil of the invention may be zero, but the solubility of additives can be further increased with a % $C_A$ value of 0.1 or greater.

The ratio of the % $C_P$ and % $C_N$ values for the lubricating base oil of the invention is % $C_P$/% $C_N$ of preferably 7 or greater, more preferably 7.5 or greater and even more preferably 8 or greater. If the % $C_P$/% $C_N$ ratio is less than 7, the viscosity-temperature characteristic, thermal and oxidation stability and frictional properties will tend to be reduced, while the efficacy of additives when added to the lubricating base oil will also tend to be reduced. The % $C_P$/% $C_N$ ratio is preferably not greater than 200, more preferably not greater than 100, even more preferably not greater than 50 and particularly preferably not greater than 25. The additive solubility can be further increased if the % $C_P$/% $C_N$ ratio is not greater than 200.

The % $C_P$, % $C_N$ and % $C_A$ values for the purpose of the invention are, respectively, the percentage of paraffinic carbons with respect to total carbon atoms, the percentage of naphthenic carbons with respect to total carbons and the percentage of aromatic carbons with respect to total carbons, as determined by the methods of ASTM D 3238-85 (n-d-M ring analysis). That is, the preferred ranges for % $C_P$, % $C_N$ and % $C_A$ are based on values determined by these methods, and for example, % $C_N$ may be a value exceeding 0 according to these methods even if the lubricating base oil contains no naphthene portion.

The iodine value of the lubricating base oil of the invention is preferably not greater than 0.5, more preferably not greater than 0.3 and even more preferably not greater than 0.15, and although it may be less than 0.01, it is preferably 0.001 or greater and more preferably 0.05 or greater in consideration of economy and achieving a significant effect. Limiting the iodine value of the lubricating base oil to not greater than 0.5 can drastically improve the thermal and oxidation stability. The "iodine value" for the purpose of the invention is the iodine value measured by the indicator titration method according to JIS K 0070, "Acid Values, Saponification Values, Iodine Values, Hydroxyl Values And Unsaponification Values Of Chemical Products".

The sulfur content in the lubricating base oil of the invention will depend on the sulfur content of the starting material. For example, when using a substantially sulfur-free starting material as for synthetic wax components obtained by Fischer-Tropsch reaction, it is possible to obtain a substantially sulfur-free lubricating base oil. When using a sulfur-containing starting material, such as slack wax obtained by a lubricating base oil refining process or microwax obtained by a wax refining process, the sulfur content of the obtained lubricating base oil will normally be 100 ppm by mass or greater. From the viewpoint of further improving the thermal and oxidation stability and reducing sulfur in the lubricating base oil of the invention, the sulfur content is preferably not greater than 10 ppm by mass, more preferably not greater than 5 ppm by mass, and even more preferably not greater than 3 ppm by mass.

From the viewpoint of cost reduction it is preferred to use slack wax or the like as the starting material, in which case the sulfur content of the obtained lubricating base oil is preferably not greater than 50 ppm by mass and more preferably not greater than 10 ppm by mass. The sulfur content for the purpose of the invention is the sulfur content measured according to JIS K 2541-1996.

The nitrogen content in the lubricating base oil of the invention is not particularly restricted, but is preferably not greater than 5 ppm by mass, more preferably not greater than 3 ppm by mass and even more preferably not greater than 1 ppm by mass. If the nitrogen content exceeds 5 ppm by mass, the thermal and oxidation stability will tend to be reduced. The nitrogen content for the purpose of the invention is the nitrogen content measured according to JIS K 2609-1990.

The dynamic viscosity of the lubricating base oil according to the invention, as the 100° C. dynamic viscosity, is preferably 1.5-20 $mm^2/s$ and more preferably 2.0-11 $mm^2/s$. A 100° C. dynamic viscosity of lower than 1.5 $mm^2/s$ for the lubricating base oil is not preferred from the standpoint of evaporation loss. If it is attempted to obtain a lubricating base oil having a 100° C. dynamic viscosity of greater than 20 $mm^2/s$, the yield will be reduced and it will be difficult to increase the cracking severity even when using a heavy wax as the starting material.

According to the invention, a lubricating base oil having a 100° C. dynamic viscosity in the following range is preferably used after fractionation by distillation or the like.

(I) A lubricating base oil with a 100° C. dynamic viscosity of at least 1.5 $mm^2/s$ and less than 3.5 $mm^2/s$, and more preferably 2.0-3.0 $mm^2/s$.

(II) A lubricating base oil with a 100° C. dynamic viscosity of at least 3.0 $mm^2/s$ and less than 4.5 $mm^2/s$, and more preferably 3.5-4.1 $mm^2/s$.

(III) A lubricating base oil with a 100° C. dynamic viscosity of 4.5-20 $mm^2/s$, more preferably 4.8-11 $mm^2/s$ and particularly preferably 5.5-8.0 $mm^2/s$.

The 40° C. dynamic viscosity of the lubricating base oil of the invention is preferably 6.0-80 $mm^2/s$ and more preferably 8.0-50 $mm^2/s$.

According to the invention, a lube-oil distillate having a 40° C. dynamic viscosity in the following ranges is preferably used after fractionation by distillation or the like.

(IV) A lubricating base oil with a 40° C. dynamic viscosity of at least 6.0 $mm^2/s$ and less than 12 $mm^2/s$, and more preferably 8.0-12 $mm^2/s$.

(V) A lubricating base oil with a 40° C. dynamic viscosity of at least 12 $mm^2/s$ and less than 28 $mm^2/s$, and more preferably 13-19 $mm^2/s$.

(VI) A lubricating base oil with a 40° C. dynamic viscosity of 28-50 $mm^2/s$, more preferably 29-45 $mm^2/s$ and particularly preferably 30-40 $mm^2/s$.

The lubricating base oils (I) and (IV), having urea adduct values and viscosity indexes satisfying the respective conditions specified above, can achieve high levels of both viscosity-temperature characteristic and low-temperature viscosity characteristic compared to conventional lubricating base oils of the same viscosity grade, and in particular they have an excellent low-temperature viscosity characteristic whereby the viscosity resistance or stirring resistance can notably reduced. Moreover, by including a pour point depressant it is possible to lower the −40° C. BF viscosity to not greater than 2000 mPa·s. The −40° C. BF viscosity is the viscosity measured according to JPI-5S-26-99.

The lubricating base oils (II) and (V), having urea adduct values and viscosity indexes satisfying the respective conditions specified above, can achieve high levels of both the viscosity-temperature characteristic and low-temperature viscosity characteristic compared to conventional lubricating base oils of the same viscosity grade, and in particular they have an excellent low-temperature viscosity characteristic, and superior lubricity and resistance to volatilization. For example, with lubricating base oils (II) and (V) it is possible to lower the −35° C. CCS viscosity to not greater than 3000 mPa·s.

The lubricating base oils (III) and (VI), having urea adduct values and viscosity indexes satisfying the respective conditions specified above, can achieve high levels of both the viscosity-temperature characteristic and low-temperature viscosity characteristic compared to conventional lubricating base oils of the same viscosity grade, and in particular they have an excellent low-temperature viscosity characteristic, and superior thermal and oxidation stability, lubricity and resistance to volatilization.

The 20° C. refractive index of the lubricating base oil of the invention will depend on the viscosity grade of the lubricating base oil, but the 20° C. refractive indexes of the lubricating base oils (I) and (IV) mentioned above are preferably not greater than 1.455, more preferably not greater than 1.453 and even more preferably not greater than 1.451. The 20° C. refractive index of the lubricating base oils (II) and (V) is preferably not greater than 1.460, more preferably not greater than 1.457 and even more preferably not greater than 1.455. The 20° C. refractive index of the lubricating base oils (III) and (VI) is preferably not greater than 1.465, more preferably not greater than 1.463 and even more preferably not greater than 1.460. If the refractive index exceeds the aforementioned upper limit, the viscosity-temperature characteristic, thermal and oxidation stability, resistance to volatilization and low-temperature viscosity characteristic of the lubricating base oil will tend to be reduced, while the efficacy of additives when added to the lubricating base oil will also tend to be reduced.

The pour point of the lubricating base oil of the invention will depend on the viscosity grade of the lubricating base oil, and for example, the pour point for the lubricating base oils (I) and (IV) is preferably not greater than −10° C., more preferably not greater than −12.5° C. and even more preferably not greater than −15° C. The pour point for the lubricating base oils (II) and (V) is preferably not greater than −10° C., more preferably not greater than −15° C. and even more preferably not greater than −17.5° C. The pour point for the lubricating base oils (III) and (VI) is preferably not greater than −10° C., more preferably not greater than −12.5° C. and even more preferably not greater than −15° C. If the pour point exceeds the upper limit specified above, the low-temperature flow properties of lubricating oils employing the lubricating base oils will tend to be reduced. The pour point for the purpose of the invention is the pour point measured according to JIS K 2269-1987.

The −35° C. CCS viscosity of the lubricating base oil of the invention will depend on the viscosity grade of the lubricating base oil, but the −35° C. CCS viscosities of the lubricating base oils (I) and (IV) are preferably not greater than 1000 mPa·s. The −35° C. CCS viscosity for the lubricating base oils (II) and (V) is preferably not greater than 3000 mPa·s, more preferably not greater than 2400 mPa·s, even more preferably not greater than 2000 mPa·s, even more preferably not greater than 1800 mPa·s and particularly preferably not greater than 1600 mPa·s. The −35° C. CCS viscosity for the lubricating base oils (III) and (VI), for example, are preferably not greater than 15000 mPa·s and more preferably not greater than 10000 mPa·s. If the −35° C. CCS viscosity exceeds the upper limit specified above, the low-temperature flow properties of lubricating oils employing the lubricating base oils will tend to be reduced. The −35° C. CCS viscosity for the purpose of the invention is the viscosity measured according to JIS K 2010-1993.

The −40° C. BF viscosity of the lubricating base oil of the invention will depend on the viscosity grade of the lubricating base oil, but the −40° C. BF viscosities of the lubricating base oils (I) and (IV), for example, are preferably not greater than 10000 mPa·s, more preferably 8000 mPa·s, and even more preferably not greater than 6000 mPa·s. The −40° C. BF viscosities of the lubricating base oils (II) and (V) are preferably not greater than 1500000 mPa·s and more preferably not greater than 1000000 mPa·s. If the −40° C. BF viscosity exceeds the upper limit specified above, the low-temperature flow properties of lubricating oils employing the lubricating base oils will tend to be reduced.

The 15° C. density ($\rho_{15}$) of the lubricating base oil of the invention will also depend on the viscosity grade of the lubricating base oil, but it is preferably not greater than the value of ρ as represented by the following formula (1), i.e., $\rho_{15} \leq \rho$.

$$\rho = 0.0025 \times kv100 + 0.816 \quad (1)$$

[In this equation, kv100 represents the 100° C. dynamic viscosity ($mm^2/s$) of the lubricating base oil.]

If $\rho_{15} > \rho$, the viscosity-temperature characteristic, thermal and oxidation stability, resistance to volatilization and low-temperature viscosity characteristic of the lubricating base oil will tend to be reduced, while the efficacy of additives when added to the lubricating base oil will also tend to be reduced.

For example, the value of $\rho_{15}$ for lubricating base oils (I) and (IV) is preferably not greater than 0.825 and more preferably not greater than 0.820. The value of $\rho_{15}$ for lubricating base oils (II) and (V) is preferably not greater than 0.835 and more preferably not greater than 0.830. Also, the value of $\rho_{15}$ for lubricating base oils (III) and (VI) is preferably not greater than 0.840 and more preferably not greater than 0.835.

The 15° C. density for the purpose of the invention is the density measured at 15° C. according to JIS K 2249-1995.

The aniline point (AP (° C.)) of the lubricating base oil of the invention will also depend on the viscosity grade of the lubricating base oil, but it is preferably greater than or equal to the value of A as represented by the following formula (2), i.e., AP≥A.

$$A = 4.3 \times kv100 + 100 \quad (2)$$

[In this equation, kv100 represents the 100° C. dynamic viscosity ($mm^2/s$) of the lubricating base oil.]

If AP<A, the viscosity-temperature characteristic, thermal and oxidation stability, resistance to volatilization and low-temperature viscosity characteristic of the lubricating base oil will tend to be reduced, while the efficacy of additives when added to the lubricating base oil will also tend to be reduced.

The AP for the lubricating base oils (I) and (IV) is preferably 108° C. or greater and more preferably 110° C. or greater. The AP for the lubricating base oils (11) and (V) is preferably 113° C. or greater and more preferably 119° C. or greater. Also, the AP for the lubricating base oils (II) and (VI) is preferably 125° C. or greater and more preferably 128° C. or greater. The aniline point for the purpose of the invention is the aniline point measured according to JIS K 2256-1985.

The NOACK evaporation amount of the lubricating base oil of the invention is not particularly restricted, and for example, the NOACK evaporation amount for lubricating base oils (I) and (IV) is preferably 20% by mass or greater, more preferably 25% by mass or greater and even more preferably 30 or greater, and preferably not greater than 50% by mass, more preferably not greater than 45% by mass and even more preferably not greater than 40% by mass. The NOACK evaporation amount for lubricating base oils (II) and (V) is preferably 5% by mass or greater, more preferably 8% by mass or greater and even more preferably 10% by mass or greater, and preferably not greater than 20% by mass, more preferably not greater than 16% by mass and even more preferably not greater than 15% by mass. The NOACK evaporation amount for lubricating base oils (III) and (VI) is preferably 0% by mass or greater and more preferably 1% by mass or greater, and preferably not greater than 6% by mass, more preferably not greater than 5% by mass and even more preferably not greater than 4% by mass. If the NOACK evaporation amount is below the aforementioned lower limit it will tend to be difficult to improve the low-temperature viscosity characteristic. If the NOACK evaporation amount is above the respective upper limit, the evaporation loss of the lubricating oil will be increased when the lubricating base oil is used as a lubricating oil for an internal combustion engine, and catalyst poisoning will be undesirably accelerated as a result. The NOACK evaporation amount for the purpose of the invention is the evaporation loss as measured according to ASTM D 5800-95.

The distillation properties of the lubricating base oil of the invention are preferably an initial boiling point (IBP) of 290-440° C. and a final boiling point (FBP) of 430-580° C. in gas chromatography distillation, and rectification of one or more fractions selected from among fractions in this distillation range can yield lubricating base oils (I)-(III) and (IV)-(VI) having the aforementioned preferred viscosity ranges.

For example, for the distillation properties of the lubricating base oils (I) and (IV), the initial boiling point (IBP) is preferably 260-340° C., more preferably 270-330° C. and even more preferably 280-320° C. The 10% distillation temperature (T10) is preferably 310-390° C., more preferably 320-380° C. and even more preferably 330-370° C. The 50% running point (T50) is preferably 340-440° C., more preferably 360-430° C. and even more preferably 370-420° C. The 90% running point (T90) is preferably 405-465° C., more preferably 415-455° C. and even more preferably 425-445° C. The final boiling point (FBP) is preferably 430-490° C., more preferably 440-480° C. and even more preferably 450-490° C. T90-T10 is preferably 60-140° C., more preferably 70-130° C. and even more preferably 80-120° C. FBP-IBP is preferably 140-200° C., more preferably 150-190° C. and even more preferably 160-180° C. T10-IBP is preferably 40-100° C., more preferably 50-90° C. and even more preferably 60-80° C. FBP-T90 is preferably 5-60° C., more preferably 10-55° C. and even more preferably 15-50° C.

For the distillation properties of the lubricating base oils (II) and (V), the initial boiling point (IBP) is preferably 310-400° C., more preferably 320-390° C. and even more preferably 330-380° C. The 10% distillation temperature (T10) is preferably 350-430° C., more preferably 360-420° C. and even more preferably 370-410° C. The 50% running point (T50) is preferably 390-470° C., more preferably 400-460° C. and even more preferably 410-450° C. The 90% running point (T90) is preferably 420-490° C., more preferably 430-480° C. and even more preferably 440-470° C. The final boiling point (FBP) is preferably 450-530° C., more preferably 460-520° C. and even more preferably 470-510° C. T90-T10 is preferably 40-100° C., more preferably 45-90° C. and even more preferably 50-80° C. FBP-IBP is preferably 110-170° C., more preferably 120-160° C. and even more preferably 130-150° C. T10-IBP is preferably 5-60° C., more preferably 10-55° C. and even more preferably 15-50° C. FBP-T90 is preferably 5-60° C., more preferably 10-55° C. and even more preferably 15-50° C.

For the distillation properties of the lubricating base oils (III) and (VI), the initial boiling point (IBP) is preferably 440-480° C., more preferably 430-470° C. and even more preferably 420-460° C. The 10% distillation temperature (T10) is preferably 450-510° C., more preferably 460-500° C. and even more preferably 460-480° C. The 50% running point (T50) is preferably 470-540° C., more preferably 480-530° C. and even more preferably 490-520° C. The 90% running point (T90) is preferably 470-560° C., more preferably 480-550° C. and even more preferably 490-540° C. The final boiling point (FBP) is preferably 505-565° C., more preferably 515-555° C. and even more preferably 525-565° C. T90-T10 is preferably 35-80° C., more preferably 45-70° C. and even more preferably 55-80° C. FBP-IBP is preferably 50-130° C., more preferably 60-120° C. and even more preferably 70-110° C. T10-IBP is preferably 5-65° C., more preferably 10-55° C. and even more preferably 10-45° C. FBP-T90 is preferably 5-60° C., more preferably 5-50° C. and even more preferably 5-40° C.

By setting IBP, T10, T50, T90, FBP, T90-T10, FBP-IBP, T10-IBP and FBP-T90 within the preferred ranges specified above for lubricating base oils (I)-(VI), it is possible to further improve the low temperature viscosity and further reduce the evaporation loss. If the distillation ranges for T90-T10, FBP-IBP, T10-IBP and FBP-T90 are too narrow, the lubricating base oil yield will be poor resulting in low economy.

The IBP, T10, T50, T90 and FBP values for the purpose of the invention are the running points measured according to ASTM D 2887-97.

The residual metal content in the lubricating base oil of the invention derives from metals in the catalyst or starting materials that become unavoidable contaminants during the production process, and it is preferred to thoroughly remove such residual metal contents. For example, the Al, Mo and Ni contents are each preferably not greater than 1 ppm by mass. If the metal contents exceed the aforementioned upper limit, the functions of additives in the lubricating base oil will tend to be inhibited.

The residual metal content for the purpose of the invention is the metal content as measured according to JPI-5S-38-2003.

The lubricating base oil of the invention preferably exhibits a RBOT life as specified below, correlating with its dynamic viscosity. For example, the RBOT life for the lubricating base oils (I) and (IV) is preferably 290 min or greater, more preferably 300 min or greater and even more preferably 310 min or greater. Also, the RBOT life for the lubricating base oils (II) and (V) is preferably 350 min or greater, more preferably 360 min or greater and even more preferably 370 min or greater. The RBOT life for the lubricating base oils (III) and (VI) is preferably 400 min or greater, more preferably 410 min or greater and even more preferably 420 min or greater. If the RBOT life of the lubricating base oil is less than the specified lower limit, the viscosity-temperature characteristic and thermal and oxidation stability of the lubricating base oil will tend to be reduced, while the efficacy of additives when added to the lubricating base oil will also tend to be reduced.

The RBOT life for the purpose of the invention is the RBOT value as measured according to JIS K 2514-1996, for a composition obtained by adding a phenol-based antioxidant (2,6-di-tert-butyl-p-cresol: DBPC) at 0.2% by mass to the lubricating base oil.

The lubricating base oil of the invention having the composition described above exhibits an excellent viscosity-temperature characteristic and low-temperature viscosity characteristic, while also having low viscosity resistance and stirring resistance and improved thermal and oxidation stability and frictional properties, making it possible to achieve an increased friction reducing effect and thus improved energy savings. When additives are included in the lubricating base oil of the invention, the functions of the additives (improved low-temperature viscosity characteristic with pour point depressants, improved thermal and oxidation stability by antioxidants, increased friction reducing effect by friction modifiers, improved wear resistance by anti-wear agents, etc.) are exhibited at a higher level. The lubricating base oil of the invention can therefore be applied as a base oil for a variety of lubricating oils. The specific use of the lubricating base oil of the invention may be as a lubricating oil for an internal combustion engine such as a passenger vehicle gasoline engine, two-wheel vehicle gasoline engine, diesel engine, gas engine, gas heat pump engine, ship engine, electric power engine or the like (internal combustion engine lubricating oil), as a lubricating oil for a drive transmission such as an automatic transmission, manual transmission, continuously variable transmission, final reduction gear or the like (drive transmission oil), as a hydraulic oil for a hydraulic power unit such as a damper, construction machine or the like, or as a compressor oil, turbine oil, industrial gear oil, refrigerator oil, rust preventing oil, heating medium oil, gas holder seal oil, bearing oil, paper machine oil, machine tool oil, sliding guide surface oil, electrical insulating oil, cutting oil, press oil, rolling oil, heat treatment oil or the like, and using the lubricating base oil of the invention for these purposes will allow the improved characteristics of the lubricating oil including the viscosity-temperature characteristic, thermal and oxidation stability, energy savings and fuel efficiency to be exhibited at a high level, together with a longer lubricating oil life and lower levels of environmentally unfriendly substances.

The lubricating oil composition of the invention may be used alone as a lubricating base oil according to the invention, or the lubricating base oil of the invention may be combined with one or more other base oils. When the lubricating base oil of the invention is combined with another base oil, the proportion of the lubricating base oil of the invention in the total mixed base oil is preferably at least 30% by mass, more preferably at least 50% by mass and even more preferably at least 70% by mass.

There are no particular restrictions on the other base oil used in combination with the lubricating base oil of the invention, and as examples of mineral oil base oils there may be mentioned solvent refined mineral oils, hydrocracked mineral oils, hydrorefined mineral oils and solvent dewaxed base oils having 100° C. dynamic viscosities of 1-100 $mm^2/s$.

As synthetic base oils there may be mentioned poly-α-olefins and their hydrogenated forms, isobutene oligomers and their hydrogenated forms, isoparaffins, alkylbenzenes, alkylnaphthalenes, diesters (ditridecyl glutarate, di-2-ethylhexyl adipate, diisodecyl adipate, ditridecyl adipate, di-2-ethylhexyl sebacate and the like), polyol esters (trimethylolpropane caprylate, trimethylolpropane pelargonate, pentaerythritol 2-ethylhexanoate, pentaerythritol pelargonate and the like), polyoxyalkylene glycols, dialkyldiphenyl ethers and polyphenyl ethers, among which poly-α-olefins are preferred. As typical poly-α-olefins there may be mentioned $C_{2-32}$ and preferably $C_{6-16}$ α-olefin oligomers or co-oligomers (1-octene oligomer, decene oligomer, ethylene-propylene co-oligomers and the like), and their hydrides.

There are no particular restrictions on the process for producing poly-α-olefins, and as an example there may be mentioned a process wherein an α-olefin is polymerized in the presence of a polymerization catalyst such as a Friedel-Crafts catalyst comprising a complex of aluminum trichloride or boron trifluoride with water, an alcohol (ethanol, propanol, butanol or the like) and a carboxylic acid or ester.

The lubricating oil composition of the invention may also contain additives if necessary. Such additives are not particularly restricted, and any additives that are commonly employed in the field of lubricating oils may be used. As specific lubricating oil additives there may be mentioned antioxidants, non-ash powders, metal cleaning agents, extreme-pressure agents, anti-wear agents, viscosity index improvers, pour point depressants, friction modifiers, oil agents, corrosion inhibitors, rust-preventive agents, demulsifiers, metal inactivating agents, seal swelling agents, anti-foaming agents, coloring agents, and the like. These additives may be used alone or in combinations of two or more. Especially when the lubricating oil composition of the invention contains a pour point depressant; it is possible to achieve an excellent low-temperature viscosity characteristic (a −40° C. MRV viscosity of preferably not greater than 20000 mPa·s, more preferably not greater than 15000 mPa·s and even more preferably not greater than 10000 mPa·s) since the effect of adding the pour point depressant is maximized by the lubricating base oil of the invention. The −40° C. MRV viscosity is the −40° C. MRV viscosity measured according to JPI-5S-42-93. When a pour point depressant is added to base oils (II) and (V), for example, it is possible to obtain a lubricating oil composition having a highly excellent low-temperature viscosity characteristic wherein the −40° C. MRV viscosity may be not greater than 12000 mPa·s, more preferably not greater than 10000 mPa·s, even more preferably 8000 mPa·s and particularly preferably not greater than 6500 mPa·s. In this case, the content of the pour point depressant is 0.05-2% by mass and preferably 0.1-1.5% by mass based on the total mass of the composition, with a range of 0.15-0.8% by mass being optimal for lowering the MRV viscosity, while the weight-average molecular weight of the pour point depressant is preferably 1-300000 and more preferably 5-200000, and the pour point depressant is preferably a polymethacrylate-based compound.

EXAMPLES

The present invention will now be explained in greater detail based on examples and comparative examples, with the understanding that these examples are in no way limitative on the invention.

Examples 1-1 to 1-3, Comparative Examples 1-1 to 1-3

For Examples 1-1 to 1-3, first the fraction separated by vacuum distillation in a process for refining of solvent refined base oil was subjected to solvent extraction with furfural and then hydrotreatment, which was followed by solvent dewaxing with a methyl ethyl ketone-toluene mixed solvent. The wax portion removed during solvent dewaxing and obtained as slack wax (hereunder, "WAX1") was used as the stock oil for the lubricating base oil. The properties of WAX1 are shown in Table 1.

TABLE 1

| Name of starting WAX | WAX1 |
|---|---|
| 100° C. Dynamic viscosity, $mm^2/s$ | 6.3 |
| Melting point, ° C. | 53 |
| Oil content, % by mass | 19.9 |
| Sulfur content, ppm by mass | 1900 |

WAX1 was then used as the stock oil for hydrotreatment with a hydrotreatment catalyst. The reaction temperature and liquid hourly space velocity during this time were controlled for a cracking severity of not greater than 10% by mass for the normal paraffins in the stock oil.

Next, the treatment product obtained from the hydrotreatment was subjected to hydrodewaxing in a temperature range of 315° C.-325° C. using a zeolite-based hydrodewaxing catalyst adjusted to a precious metal content of 0.1-5 wt %.

The treatment product (raffinate) obtained by this hydrodewaxing was subsequently treated by hydrorefining using a hydrorefining catalyst. Next, the light and heavy portions were separated by distillation to obtain a lubricating base oil having the compositions and properties shown in Tables 2-4. Tables 2-4 also show the compositions and properties of conventional lubricating base oils obtained using WAX1, for Comparative Examples 1-1 to 1-3. In Table 1, the row headed "Proportion of normal paraffin-derived components in urea adduct" contains the values obtained by gas chromatography of the urea adduct obtained during measurement of the urea adduct value (same hereunder).

A polymethacrylate-based pour point depressant (weight-average molecular weight: approximately 60000) commonly used in automobile lubricating oils was added to the lubricating base oils of Example 1-1 and Comparative Example 1-1 to obtain lubricating oil compositions. The pour point depressant was added in three different amounts of 0.3% by mass, 0.5% by mass and 1.0% by mass based on the total mass of the composition, for both Example 1 and Comparative Example 1. The −40° C. MRV viscosity of each of the obtained lubricating oil compositions was then measured. The results are shown in Table 2.

TABLE 2

| | | Example 1-1 | Comparative Example 1-1 |
|---|---|---|---|
| stock oil | | WAX1 | WAX1 |
| Urea adduct value, % by mass | | 1.25 | 4.44 |
| Proportion of normal paraffin-derived components in urea adduct, % by mass | | 2.4 | 7.8 |
| Base oil composition (based on total base oil) | Saturated, % by mass | 99.6 | 99.7 |
| | Aromatic, % by mass | 0.2 | 0.1 |
| | Polar compounds, % by mass | 0.1 | 0.2 |
| Saturated components (based on total saturated components) | Cyclic saturated, % by mass | 12.9 | 12.7 |
| | Acyclic saturated, % by mass | 87.1 | 87.3 |

TABLE 2-continued

| | | Example 1-1 | Comparative Example 1-1 |
|---|---|---|---|
| Acyclic saturated components in base oil (based on total base oil) | Normal paraffins, % by mass | 0 | 0.3 |
| | Isoparaffins, % by mass | 86.8 | 86.8 |
| Acyclic saturated components (based on total acyclic saturated content) | Normal paraffins, % by mass | 0 | 0.3 |
| | Isoparaffins, % by mass | 100 | 99.7 |
| Sulfur content, ppm by mass | | <1 | <1 |
| Nitrogen content, ppm by mass | | <3 | <3 |
| Dynamic viscosity (40° C.), $mm^2/s$ | | 15.8 | 15.9 |
| Dynamic viscosity (100° C.), $mm^2/s$ | | 3.85 | 3.86 |
| NOACK evaporation amount (250° C., 1 hr), % by mass | | 12.6 | 16.2 |
| Product of 40° C. dynamic viscosity and NOACK evaporation amount | | 199 | 258 |
| Viscosity index | | 141 | 141 |
| Density (15° C.), $g/cm^3$ | | 0.8195 | 0.8199 |
| Pour point, ° C. | | −22.5 | −22.5 |
| Freezing point, ° C. | | −26 | −25 |
| Iodine value | | 0.06 | 0.10 |
| Aniline point, ° C. | | 118.5 | 118.0 |
| Distillation properties, ° C. | IBP, ° C. | 363 | 361 |
| | T10, ° C. | 396 | 395 |
| | T50, ° C. | 432 | 433 |
| | T90, ° C. | 459 | 460 |
| | FBP, ° C. | 489 | 488 |
| CCS viscosity (−35° C.), mPa · s | | 1450 | 1520 |
| BF viscosity (−40° C.), mPa · s | | — | — |
| Residual metals | Al, ppmby mass | <1 | <1 |
| | Mo, ppm by mass | <1 | <1 |
| | Ni, ppm by mass | <1 | <1 |
| MRV viscosity (−40° C.), mPa · s | Pour point depressant, 0.3% by mass | 5900 | 12000 |
| | Pour point depressant, 0.5% by mass | 5700 | 11000 |
| | Pour point depressant, 1.0% by mass | 6500 | 13200 |

TABLE 3

| | | Example 1-2 | Comparative Example 1-2 |
|---|---|---|---|
| stock oil | | WAX1 | WAX1 |
| Urea adduct value, % by mass | | 1.09 | 4.12 |
| Proportion of normal paraffin-derived components in urea adduct, % by mass | | 1.9 | 6.9 |
| Base oil composition (based on total base oil) | Saturated, % by mass | 99.2 | 98.9 |
| | Aromatic, % by mass | 0.4 | 0.7 |
| | Polar compounds, % by mass | 0.4 | 0.4 |
| Saturated components (based on total saturated components) | Cyclic saturated, % by mass | 17.5 | 18.3 |
| | Acyclic saturated, % by mass | 82.5 | 81.7 |
| Acyclic saturated components in base oil (based on total base oil) | Normal paraffins, % by mass | 0.0 | 0.3 |
| | Isoparaffins, % by mass | 81.4 | 80.8 |
| Acyclic saturated components (based on total acyclic saturated content) | Normal paraffins, % by mass | 0.1 | 0.4 |
| | Isoparaffins, % by mass | 99.9 | 99.6 |
| Sulfur content, ppm by mass | | <1 | <1 |
| Nitrogen content, ppm by mass | | <3 | <3 |
| Dynamic viscosity (40° C.), $mm^2/s$ | | 32.1 | 31.8 |
| Dynamic viscosity (100° C.), $mm^2/s$ | | 6.27 | 6.46 |
| Viscosity index | | 154 | 160 |
| Density (15° C.), $g/cm^3$ | | 0.827 | 0.823 |
| Pour point, ° C. | | −17.5 | −15 |
| Freezing point, ° C. | | −19 | −17 |
| Iodine value | | 0.05 | 0.10 |
| Aniline point, ° C. | | 125.1 | 124.7 |
| Distillation properties, ° C. | IBP, ° C. | 442 | 444 |
| | T10, ° C. | 468 | 468 |
| | T50, ° C. | 497 | 499 |
| | T90, ° C. | 516 | 517 |
| | FBP, ° C. | 523 | 531 |
| CCS viscosity (−35° C.), mPa · s | | 7,200 | 14,500 |

TABLE 4

| | | Example 1-3 | Comparative Example 1-3 |
|---|---|---|---|
| stock oil | | WAX1 | WAX1 |
| Urea adduct value, % by mass | | 1.62 | 4.22 |
| Proportion of normal paraffin-derived components in urea adduct, % by mass | | 13.8 | 22.5 |
| Base oil composition (based on total base oil) | Saturated, % by mass | 99.5 | 99.4 |
| | Aromatic, % by mass | 0.3 | 0.4 |
| | Polar compounds, % by mass | 0.2 | 0.2 |
| Saturated components (based on total saturated components) | Cyclic saturated, % by mass | 8.9 | 7.7 |
| | Acyclic saturated, % by mass | 91.1 | 92.3 |
| Acyclic saturated components in base oil (based on total base oil) | Normal paraffins, % by mass | 0.3 | 0.9 |
| | Isoparaffins, % by mass | 90.7 | 90.1 |
| Acyclic saturated components (based on total acyclic saturated content) | Normal paraffins, % by mass | 0.2 | 0.8 |
| | Isoparaffins, % by mass | 99.8 | 99.2 |
| Sulfur content, ppm by mass | | <1 | <1 |
| Nitrogen content, ppm by mass | | <3 | <3 |
| Dynamic viscosity (40° C.), $mm^2/s$ | | 9.90 | 9.91 |
| Dynamic viscosity (100° C.), $mm^2/s$ | | 2.79 | 2.77 |
| Viscosity index | | 127 | 127 |
| Density (15° C.), $g/cm^3$ | | 0.811 | 0.812 |
| Pour point, ° C. | | −35 | −32.5 |
| Freezing point, ° C. | | −36 | −33 |
| Iodine value | | 0.12 | 0.20 |
| Aniline point, ° C. | | 111.8 | 111.7 |
| Distillation properties, ° C. | IBP, ° C. | 292 | 297 |
| | T10, ° C. | 350 | 356 |
| | T50, ° C. | 395 | 399 |
| | T90, ° C. | 425 | 431 |
| | FBP, ° C. | 452 | 459 |
| Evaporation (NOACK, 250° C., 1 h), mass % | | 44 | 65 |
| CCS viscosity (−35° C.), mPa · s | | <1400 | <1400 |
| BF viscosity (−30° C.), mPa · s | | <1,000 | 7,600 |
| BF viscosity (−35° C.), mPa · s | | 1,880 | 19,400 |
| BF viscosity (−40° C.), mPa · s | | 110,200 | 757,000 |
| Residual metals | Al, ppm by mass | <1 | <1 |
| | Mo, ppm by mass | <1 | <1 |
| | Ni, ppm by mass | <1 | <1 |

Examples 2-1 to 2-3, Comparative Examples 2-1 to 2-3

For Examples 2-1 to 2-3, the wax portion obtained by further deoiling of WAX1 (hereunder, "WAX2") was used as the stock oil for the lubricating base oil. The properties of WAX2 are shown in Table 5.

TABLE 5

| Name of starting WAX | WAX2 |
|---|---|
| 100° C. Dynamic viscosity, $mm^2/s$ | 6.8 |
| Melting point, ° C. | 58 |
| Oil content, % by mass | 6.3 |
| Sulfur content, ppm by mass | 900 |

Hydrotreatment, hydrodewaxing, hydrorefining and distillation were carried out in the same manner as in Examples 1-1 to 1-3, except for using WAX2 instead of WAX1, to obtain lubricating base oils having the compositions and properties listed in Tables 6 to 8. Tables 6 to 8 also show the compositions and properties of conventional lubricating base oils obtained using WAX2, for Comparative Examples 2-1 to 2-3.

A lubricating oil composition containing a polymethacrylate-based pour point depressant was then prepared in the same manner as Example 1-1, except for using the lubricating base oils of Example 2-1 and Comparative Example 2-1, and the −40° C. MRV viscosity was measured. The results are shown in Table 6.

TABLE 6

| | | Example 2-1 | Comparative Example 2-1 |
|---|---|---|---|
| stock oil | | WAX2 | WAX2 |
| Urea adduct value, % by mass | | 1.22 | 4.35 |
| Proportion of normal paraffin-derived components in urea adduct, % by mass | | 2.5 | 8.1 |
| Base oil composition (based on total base oil) | Saturated, % by mass | 99.6 | 99.7 |
| | Aromatic, % by mass | 0.2 | 0.3 |
| | Polar compounds, % by mass | 0.2 | 0 |
| Saturated components (based on total saturated components) | Cyclic saturated, % by mass | 10.2 | 10.3 |
| | Acyclic saturated, % by mass | 89.8 | 89.7 |

TABLE 6-continued

| | | Example 2-1 | Comparative Example 2-1 |
|---|---|---|---|
| Acyclic saturated components in base oil (based on total base oil) | Normal paraffins, % by mass | 0 | 0.4 |
| | Isoparaffins, % by mass | 89.4 | 89.4 |
| Acyclic saturated components (based on total acyclic saturated content) | Normal paraffins, % by mass | 0 | 0.4 |
| | Isoparaffins, % by mass | 100 | 99.6 |
| Sulfur content, ppm by mass | | <1 | <1 |
| Nitrogen content, ppm by mass | | <3 | <3 |
| Dynamic viscosity (40° C.), $mm^2/s$ | | 16.0 | 16.0 |
| Dynamic viscosity (100° C.), $mm^2/s$ | | 3.88 | 3.89 |
| Viscosity index | | 141 | 142 |
| NOACK evaporation amount (25° C., 1 hr), % by mass | | 13.1 | 16.5 |
| Product of 40° C. dynamic viscosity and NOACK evaporation amount | | 210 | 264 |
| Density (15° C.), $g/cm^3$ | | 0.8197 | 0.8191 |
| Pour point, ° C. | | −22.5 | −22.5 |
| Freezing point, ° C. | | −24 | −24 |
| Iodine value | | 0.06 | 0.09 |
| Aniline point, ° C. | | 118.6 | 118.5 |
| Distillation properties, ° C. | IBP, ° C. | 361 | 359 |
| | T10, ° C. | 399 | 400 |
| | T50, ° C. | 435 | 433 |
| | T90, ° C. | 461 | 459 |
| | FBP, ° C. | 490 | 487 |
| CCS viscosity (−35° C.), mPa · s | | 1420 | 1460 |
| BF viscosity (−40° C.), mPa · s | | 875000 | — |
| Residual metals | Al, ppm by mass | <1 | <1 |
| | Mo, ppm by mass | <1 | <1 |
| | Ni, ppm by mass | <1 | <1 |
| MRV viscosity (−40° C.), mPa · s | Pour point depressant, 0.3% by mass | 6200 | 13700 |
| | Pour point depressant, 0.5% by mass | 6000 | 13000 |
| | Pour point depressant, 1.0% by mass | 6700 | 14500 |

TABLE 7

| | | Example 2-2 | Comparative Example 2-2 |
|---|---|---|---|
| stock oil | | WAX2 | WAX2 |
| Urea adduct value, % by mass | | 0.88 | 4.28 |
| Proportion of normal paraffin-derived components in urea adduct, % by mass | | 2.10 | 7.08 |
| Base oil composition (based on total base oil) | Saturated, % by mass | 99.4 | 99.1 |
| | Aromatic, % by mass | 0.4 | 0.6 |
| | Polar compounds, % by mass | 0.2 | 0.3 |
| Saturated components (based on total saturated components) | Cyclic saturated, % by mass | 15.6 | 15.5 |
| | Acyclic saturated, % by mass | 84.4 | 84.5 |
| Acyclic saturated components in base oil (based on total base oil) | Normal paraffins, % by mass | 0.2 | 0.4 |
| | Isoparaffins, % by mass | 84.2 | 84.1 |
| Acyclic saturated components (based on total acyclic saturated content) | Normal paraffins, % by mass | 0.1 | 0.4 |
| | Isoparaffins, % by mass | 99.9 | 99.6 |
| Sulfur content, ppm by mass | | <1 | <1 |
| Nitrogen content, ppm by mass | | <3 | <3 |
| Dynamic viscosity (40° C.), $mm^2/s$ | | 31.2 | 30.8 |
| Dynamic viscosity (100° C.), $mm^2/s$ | | 5.95 | 6.17 |
| Viscosity index | | 155 | 158 |
| Density (15° C.), $g/cm^3$ | | 0.827 | 0.826 |
| Pour point, ° C. | | −20 | −17.5 |
| Freezing point, ° C. | | −22 | −19 |
| Iodine value | | 0.010 | 0.09 |
| Aniline point, ° C. | | 125.7 | 126.0 |
| Distillation properties, ° C. | IBP, ° C. | 437 | 440 |
| | T10, ° C. | 466 | 468 |
| | T50, ° C. | 492 | 500 |
| | T90, ° C. | 518 | 515 |
| | FBP, ° C. | 532 | 531 |
| CCS viscosity (−35° C.), mPa · s | | 6,600 | 13,300 |

TABLE 8

| | | Example 2-3 | Comparative Example 2-3 |
|---|---|---|---|
| stock oil | | WAX2 | WAX2 |
| Urea adduct value, % by mass | | 1.47 | 4.55 |
| Proportion of normal paraffin-derived components in urea adduct, % by mass | | 14.9 | 23.9 |
| Base oil composition (based on total base oil) | Saturated, % by mass | 99.7 | 99.9 |
| | Aromatic, % by mass | 0.2 | 0.1 |
| | Polar compounds, % by mass | 0.1 | 0.1 |
| Saturated components (based on total saturated components) | Cyclic saturated, % by mass | 8.6 | 8.7 |
| | Acyclic saturated, % by mass | 91.4 | 91.3 |
| Acyclic saturated components in base oil (based on total base oil) | Normal paraffins, % by mass | 0.3 | 1.1 |
| | Isoparaffin, % by mass | 91.1 | 90.2 |
| Acyclic saturated components (based on total acyclic saturated content) | Normal paraffins, % by mass | 0.3 | 1.2 |
| | Isoparaffins, % by mass | 99.7 | 98.8 |
| Sulfur content, ppm by mass | | <1 | <1 |
| Nitrogen content, ppm by mass | | <3 | <3 |
| Dynamic viscosity (40° C.), $mm^2/s$ | | 10.02 | 9.95 |
| Dynamic viscosity (100° C.), $mm^2/s$ | | 2.80 | 2.80 |
| Viscosity index | | 125 | 128 |
| Density (15° C.), $g/cm^3$ | | 0.812 | 0.813 |
| Pour point, ° C. | | −30 | −30.0 |
| Freezing point, ° C. | | −32 | −31 |
| Iodine value | | 0.01 | 0.04 |
| Aniline point, ° C. | | 112.5 | 111.2 |
| Distillation properties, ° C. | IBP, ° C. | 298 | 294 |
| | T10, ° C. | 352 | 354 |
| | T50, ° C. | 394 | 297 |
| | T90, ° C. | 421 | 420 |
| | FBP, ° C. | 448 | 450 |
| Evaporation (NOACK, 250° C., 1 h), mass % | | 44 | 66 |
| CCS viscosity (−35° C.), mPa · s | | <1400 | <1400 |
| BF viscosity (−30° C.), mPa · s | | <1,000 | 1,950 |
| BF viscosity (−35° C.), mPa · s | | 1,870 | 23,200 |
| BF viscosity (−40° C.), mPa · s | | 97,400 | 871,000 |
| Residual metals | Al, ppm by mass | <1 | <1 |
| | Mo, ppm by mass | <1 | <1 |
| | Ni, ppm by mass | <1 | <1 |

Examples 3-1 to 3-3, Comparative Examples 3-1 to 3-3

For each of Examples 3-1 to 3-3 there was used a FT wax with a paraffin content of 95% by mass and a carbon number distribution of 20-80 (hereunder, "WAX3"). The properties of WAX3 are shown in Table 9.

TABLE 9

| Name of starting WAX | WAX3 |
|---|---|
| 100° C. Dynamic viscosity, $mm^2/s$ | 5.8 |
| Melting point, ° C. | 70 |
| Oil content, % by mass | <1 |
| Sulfur content, ppm by mass | <0.2 |

Hydrotreatment, hydrodewaxing, hydrorefining and distillation were carried out in the same manner as in Examples 1-1 to 1-3, except for using WAX3 instead of WAX1, to obtain a lubricating base oil having the composition and properties listed in Tables 10-12. Tables 10 to 12 also show the compositions and properties of conventional lubricating base oils obtained using WAX3, for Comparative Examples 3-1 to 3-3.

A lubricating oil composition containing a polymethacrylate-based pour point depressant was then prepared in the same manner as Example 1, except for using the lubricating base oils of Example 3-1 and Comparative Example 3-1, and the −40° C. MRV viscosity was measured. The results are shown in Table 6.

TABLE 10

| | | Example 3-1 | Comparative Example 3-1 |
|---|---|---|---|
| stock oil | | WAX3 | WAX3 |
| Urea adduct value, % by mass | | 1.18 | 4.15 |
| Proportion of normal paraffin-derived components in urea adduct, % by mass | | 2.5 | 8.2 |
| Base oil composition (based on total base oil) | Saturated, % by mass | 99.8 | 99.8 |
| | Aromatic, % by mass | 0.1 | 0.2 |
| | Polar compounds, % by mass | 0.1 | 0 |
| Saturated components (based on total saturated components) | Cyclic saturated, % by mass | 11.5 | 9.8 |
| | Acyclic saturated, % by mass | 88.5 | 90.2 |

TABLE 10-continued

| | | Example 3-1 | Comparative Example 3-1 |
|---|---|---|---|
| Acyclic saturated components in base oil (based on total base oil) | Normal paraffins, % by mass | 0 | 0.3 |
| | Isoparaffins, % by mass | 88.5 | 89.9 |
| Acyclic saturated components (based on total acyclic saturated content) | Normal paraffins, % by mass | 0 | 0.3 |
| | Isoparaffins, % by mass | 100 | 99.7 |
| Sulfur content, ppm by mass | | <10 | <10 |
| Nitrogen content, ppm by mass | | <3 | <3 |
| Dynamic viscosity (40° C.), $mm^2/s$ | | 15.9 | 15.9 |
| Dynamic viscosity (100° C.), $mm^2/s$ | | 3.90 | 3.87 |
| Viscosity index | | 142 | 142 |
| NOACK evaporation amount (250° C., 1 hr), % by mass | | 14.1 | 16.8 |
| Product of 40° C. dynamic viscosity and NOACK evaporation amount | | 224 | 267 |
| Density (15° C.), $g/cm^3$ | | 0.8170 | 0.8175 |
| Pour point, ° C. | | −22.5 | −22.5 |
| Freezing point, ° C. | | −24 | −24 |
| Iodine value | | 0.04 | 0.05 |
| Aniline point, ° C. | | 119.0 | 118.0 |
| Distillation properties, ° C. | IBP, ° C. | 360 | 362 |
| | T10, ° C. | 400 | 397 |
| | T50, ° C. | 436 | 439 |
| | T90, ° C. | 465 | 460 |
| | FBP, ° C. | 491 | 488 |
| CCS viscosity (−35° C.), mPa · s | | 1480 | 1470 |
| BF viscosity (−40° C.), mPa · s | | 882000 | — |
| Residual metals | Al, ppm by mass | <1 | <1 |
| | Mo, ppm by mass | <1 | <1 |
| | Ni, ppm by mass | <1 | <1 |
| MRV viscosity (−40° C.), mPa · s | Pour point depressant, 0.3% by mass | 5700 | 12000 |
| | Pour point depressant, 0.5% by mass | 5750 | 11800 |
| | Pour point depressant, 1.0% by mass | 6000 | 13000 |

TABLE 11

| | | Example 3-2 | Comparative Example 3-2 |
|---|---|---|---|
| stock oil | | WAX3 | WAX3 |
| Urea adduct value, % by mass | | 0.81 | 4.77 |
| Proportion of normal paraffin-derived components in urea adduct, % by mass | | 1.9 | 7.2 |
| Base oil composition (based on total base oil) | Saturated, % by mass | 99.7 | 99.5 |
| | Aromatic, % by mass | 0.1 | 0.3 |
| | Polar compounds, % by mass | 0.2 | 0.2 |
| Saturated components (based on total saturated components) | Cyclic saturated, % by mass | 15.8 | 14.9 |
| | Acyclic saturated, % by mass | 84.2 | 85.3 |
| Acyclic saturated components in base oil (based on total base oil) | Normal paraffins, % by mass | 0 | 0.4 |
| | Isoparaffins, % by mass | 84.2 | 84.9 |
| Acyclic saturated components (based on total acyclic saturated content) | Normal paraffins, % by mass | 0 | 0.4 |
| | Isoparaffins, % by mass | 100 | 99.6 |
| Sulfur content, ppm by mass | | <10 | <10 |
| Nitrogen content, ppm by mass | | <3 | <3 |
| Dynamic viscosity (40° C.), $mm^2/s$ | | 33.2 | 32.6 |
| Dynamic viscosity (100° C.), $mm^2/s$ | | 6.48 | 6.40 |
| Viscosity index | | 160 | 159 |
| Density (15° C.), $g/cm^3$ | | 0.826 | 0.827 |
| Pour point, ° C. | | −20 | −17.5 |
| Freezing point, ° C. | | −21 | −19 |
| Iodine value | | 0.15 | 0.03 |
| Aniline point, ° C. | | 125.5 | 124.3 |
| Distillation properties, ° C. | IBP, ° C. | 440 | 449 |
| | T10, ° C. | 468 | 473 |
| | T50, ° C. | 497 | 499 |
| | T90, ° C. | 515 | 516 |
| | FBP, ° C. | 530 | 531 |
| CCS viscosity (−35° C.), mPa · s | | 6,800 | 12,400 |

TABLE 12

| | | Example 3-3 | Comparative Example 3-3 |
|---|---|---|---|
| stock oil | | WAX3 | WAX3 |
| Urea adduct value, % by mass | | 1.44 | 4.55 |
| Proportion of normal paraffin-derived components in urea adduct, % by mass | | 13.9 | 23.2 |
| Base oil composition (based on total base oil) | Saturated, % by mass | 99.7 | 99.6 |
| | Aromatic, % by mass | 0.2 | 0.2 |
| | Polar compounds, % by mass | 0.1 | 0.2 |
| Saturated components (based on total saturated components) | Cyclic saturated, % by mass | 8.6 | 8.1 |
| | Acyclic saturated, % by mass | 91.4 | 91.9 |
| Acyclic saturated components in base oil (based on total base oil) | Normal paraffins, % by mass | 0.3 | 0.5 |
| | Isoparaffins, % by mass | 91.1 | 91.4 |
| Acyclic saturated components (based on total acyclic saturated content) | Normal paraffins, % by mass | 0.2 | 1.0 |
| | Isoparaffins, % by mass | 99.8 | 99.0 |
| Sulfur content, ppm by mass | | <10 | <10 |
| Nitrogen content, ppm by mass | | <3 | <3 |
| Dynamic viscosity (40° C.), $mm^2/s$ | | 10.03 | 9.98 |
| Dynamic viscosity (100° C.), $mm^2/s$ | | 2.80 | 2.77 |
| Viscosity index | | 125 | 125 |
| Density (15° C.), $g/cm^3$ | | 0.812 | 0.812 |
| Pour point, ° C. | | −30 | −30 |
| Freezing point, ° C. | | −32 | −33 |
| Iodine value, mgKOH/g | | 0.11 | 0.09 |
| Aniline point, ° C. | | 112.5 | 111.9 |
| Distillation properties, ° C. | IBP, ° C. | 291 | 292 |
| | T10, ° C. | 354 | 353 |
| | T50, ° C. | 393 | 390 |
| | T90, ° C. | 425 | 427 |
| | FBP, ° C. | 451 | 455 |
| Evaporation (NOACK, 250° C., 1 h), mass % | | 39 | 59 |
| CCS viscosity (−35° C.), mPa · s | | <1,400 | <1,400 |
| BF viscosity (−35° C.), mPa · s | | <1,000 | 16,300 |
| BF viscosity (−40° C.), mPa · s | | 83,000 | 918,000 |
| Residual metals | Al, ppm by mass | <1 | <1 |
| | Mo, ppm by mass | <1 | <1 |
| | Ni, ppm by mass | <1 | <1 |

Examples 4-1 to 4-3, Comparative Examples 4-1 to 4-4

For Examples 4-1 to 4-3 there was used a bottom fraction obtained from a hydrotreatment apparatus, using a high hydrogen pressure hydrotreatment apparatus.

Hydrotreatment, hydrodewaxing, hydrorefining and distillation were carried out in the same manner as in Examples 1-1 to 1-3, except for using the aforementioned stock oil instead of WAX1, to obtain a lubricating base oil having the composition and properties listed in Table 13. Table 13 also shows the composition and properties of a conventional lubricating base oil obtained using the same starting materials as Examples 4-1, for Comparative Example 4-1.

Lubricating oil compositions each containing a polymethacrylate-based pour point depressant were then prepared in the same manner as Examples 1-1 to 1-3, except for using the lubricating base oils of Example 4-1 and Comparative Example 4-1, and the −40° C. MRV viscosity was measured. The results are shown in Table 13.

TABLE 13

| | | Example 4-1 | Comparative Example 4-1 |
|---|---|---|---|
| stock oil | | Hydrocracking bottom | Hydrocracking bottom |
| Urea adduct value, % by mass | | 2.23 | 4.51 |
| Proportion of normal paraffin-derived components in urea adduct, % by mass | | 1.2 | 2.25 |
| Base oil composition (based on total base oil) | Saturated, % by mass | 99.9 | 99.9 |
| | Aromatic, % by mass | 0.1 | 0.1 |
| | Polar compounds, % by mass | 0 | 0 |
| Saturated components (based on total saturated components) | Cyclic saturated, % by mass | 46.0 | 46.0 |
| | Acyclic saturated, % by mass | 54.0 | 54.0 |
| Acyclic saturated components in base oil (based on total base oil) | Normal paraffins, % by mass | 0.1 | 0.1 |
| | Isoparaffins, % by mass | 53.8 | 53.8 |
| Acyclic saturated components (based on total acyclic saturated content) | Normal paraffins, % by mass | 0.2 | 0.2 |
| | Isoparaffins, % by mass | 99.8 | 99.8 |
| Sulfur content, ppm by mass | | <1 | <1 |
| Nitrogen content, ppm by mass | | <3 | <3 |

TABLE 13-continued

| | | Example 4-1 | Comparative Example 4-1 |
|---|---|---|---|
| Dynamic viscosity (40° C.), $mm^2/s$ | | 19.90 | 19.50 |
| Dynamic viscosity (100° C.), $mm^2/s$ | | 4.300 | 4.282 |
| Viscosity index | | 125 | 127 |
| Density (15° C.), $g/cm^3$ | | 0.8350 | 0.8350 |
| Pour point, ° C. | | −17.5 | −17.5 |
| Freezing point, ° C. | | −20 | −20 |
| Iodine value | | 0.05 | 0.05 |
| Aniline point, ° C. | | 116.0 | 116.0 |
| Distillation properties, ° C. | IBP, ° C. | 314 | 310 |
| | T10, ° C. | 393 | 390 |
| | T50, ° C. | 426 | 430 |
| | T90, ° C. | 459 | 461 |
| | FBP, ° C. | 505 | 510 |
| CCS viscosity (−35° C.), mPa · s | | 3000 | 6800 |
| BF viscosity (−40° C.), mPa · s | | | |
| Residual metals | Al, ppm by mass | <1 | <1 |
| | Mo, ppm by mass | <1 | <1 |
| | Ni, ppm by mass | <1 | <1 |
| MRV viscosity (−40° C.), mPa · s | Pour point depressant, 0.3% by mass | 7800 | 20200 |
| | Pour point depressant, 0.5% by mass | 7200 | 19000 |
| | Pour point depressant, 1.0% by mass | 8100 | 21000 |

The invention claimed is:

1. A lubricating base oil having an urea adduct value of not greater than 4% by mass and a viscosity index of 100 or greater, and comprising a saturated component that contains cyclic and acyclic components, wherein the saturated component content is 90 wt % or greater based on the total weight of the lubricating base oil, and wherein the proportion of cyclic saturated components among the saturated components is 0.1-50 wt %.

2. A lubricating oil composition comprising the lubricating base oil according to claim 1.

3. The lubricating base oil according to claim 1, wherein the urea adduct value is not greater than 3.5% by mass.

4. The lubricating base oil according to claim 1, wherein the urea adduct value is not greater than 3% by mass.

5. The lubricating base oil according to claim 1, wherein the urea adduct value is not greater than 2.5% by mass.

6. The lubricating base oil according to claim 1, wherein the viscosity index is 110 or greater.

7. The lubricating base oil according to claim 1, wherein the viscosity index is 120 or greater.

* * * * *